US007320184B2

(12) United States Patent
Zhang et al.

(10) Patent No.: US 7,320,184 B2
(45) **Date of Patent: *Jan. 22, 2008**

(54) FABRIC ARTICLE TREATING SYSTEM AND METHOD

(75) Inventors: Shulin Larry Zhang, West Chester, OH (US); Trace Wendell de Guzman Trajano, Mason, OH (US); Kofi Ofosu-Asante, Cincinnati, OH (US); Joseph Dean Heatherly, Morrow, OH (US); Freddy Arthur Barnabas, West Chester, OH (US); Jamie Marie Childers, Loveland, OH (US); Cynthia Maria Bedell, Cincinnati, OH (US); Dean Larry DuVal, Lebanon, OH (US); Joia Kirin Spooner-Wyman, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 3 days.

This patent is subject to a terminal disclaimer.

(21) Appl. No.: 11/344,314

(22) Filed: Jan. 31, 2006

(65) Prior Publication Data

US 2006/0123654 A1 Jun. 15, 2006

Related U.S. Application Data

(63) Continuation of application No. 10/842,926, filed on May 11, 2004, now Pat. No. 7,047,663, and a continuation-in-part of application No. 10/839,549, filed on May 5, 2004, which is a continuation-in-part of application No. 10/762,152, filed on Jan. 21, 2004, which is a continuation-in-part of application No. 10/697,736, filed on Oct. 29, 2003, and a continuation-in-part of application No. 10/697,734, filed on Oct. 29, 2003, and a continuation-in-part of application No. 10/697,685, filed on Oct. 29, 2003, now Pat. No. 7,043,855, and a continuation-in-part of application No. 10/697,735, filed on Oct. 29, 2003, now Pat. No. 7,146,749, which is a continuation-in-part of application No. 10/418,595, filed on Apr. 17, 2003, now Pat. No. 7,059,065.

(60) Provisional application No. 60/374,601, filed on Apr. 22, 2002, provisional application No. 60/568,771, filed on May 6, 2004, provisional application No. 60/426,438, filed on Nov. 14, 2002.

(51) Int. Cl.
*F26B 11/00* (2006.01)

(52) U.S. Cl. ..... 34/597; 8/115.51

(58) Field of Classification Search ..... 34/343, 34/348, 389, 390, 595, 597; 8/115.51, 181, 8/127.1, 115.56, 115.64
See application file for complete search history.

(56) References Cited

U.S. PATENT DOCUMENTS 2,079,280 A 5/1937 Couch (Continued)

FOREIGN PATENT DOCUMENTS

DE 23 18 596 B2 4/1980

(Continued)

OTHER PUBLICATIONS

U.S. Appl. No. 11/592,359, filed Nov. 3, 2006, Barron et al.

(Continued)

*Primary Examiner*—Jiping Lu
(74) *Attorney, Agent, or Firm*—Julia A. Glazer; Kim William Zerby; Steve Miller

(57) ABSTRACT

Systems and methods useful for treating a fabric article with a composition comprising polyol-based fabric care materials and a dispersing medium. The dispersing medium is a liquid at room temperature and has a flash point of greater than about 65° C. Specifically, the composition may be dispensed to treat fabric articles in an appliance during the fabric article drying process.

18 Claims, 12 Drawing Sheets

U.S. PATENT DOCUMENTS 2,807,893 A 10/1957 Morey
2,812,593 A 11/1957 Olthuis
2,846,776 A 8/1958 Clark
2,851,791 A 9/1958 Olthuis
2,873,539 A 2/1959 Morey
2,941,309 A 6/1960 Cobb
2,958,954 A 11/1960 Longenecker
3,002,288 A 10/1961 Conlee
3,022,580 A 2/1962 Doty
3,103,450 A 9/1963 Janson
3,114,653 A 12/1963 Kruzan
3,172,604 A 3/1965 Brock
3,180,037 A 4/1965 Kenreich et al.
3,239,947 A 3/1966 Kenreich et al.
3,267,701 A 8/1966 Mandarino
3,364,585 A 1/1968 Fish
3,583,180 A 6/1971 Arbogast
3,595,036 A 7/1971 Laddle
3,634,947 A 1/1972 Furgal
3,816,070 A 6/1974 Candor et al.
3,872,604 A 3/1975 Keller
4,009,598 A 3/1977 Bernard et al.
4,014,105 A 3/1977 Furgal et al.
4,022,938 A 5/1977 Zaki et al.
4,098,937 A 7/1978 Mizuno et al.
4,161,283 A * 7/1979 Hyman ..... 239/55
4,207,683 A 6/1980 Horton
4,236,320 A 12/1980 Schwadike et al.
4,242,377 A 12/1980 Roberts et al.
4,341,347 A 7/1982 DeVittorio
4,501,682 A 2/1985 Goodman et al.
4,511,495 A 4/1985 Melville
4,532,722 A 8/1985 Sax
4,567,675 A 2/1986 Rennie
4,579,279 A 4/1986 Marchant
4,618,099 A 10/1986 Nagao et al.
4,642,908 A 2/1987 Brenner
4,806,254 A 2/1989 Church
4,891,890 A 1/1990 Church
5,040,311 A 8/1991 Roy
5,234,610 A 8/1993 Gardlik et al.
5,438,773 A 8/1995 Chaffee
5,442,938 A 8/1995 Kislyuk
5,445,747 A 8/1995 Kvietok et al.
5,461,742 A 10/1995 Pasad et al.
5,595,071 A 1/1997 Pasad et al.
5,749,163 A 5/1998 Staub et al.
5,771,604 A 6/1998 Wunderlich et al.
5,789,368 A 8/1998 You et al.
5,810,265 A 9/1998 Cornelius et al.
5,884,418 A 3/1999 McNally
5,912,408 A 6/1999 Trinh et al.
5,930,909 A 8/1999 McNally
5,945,111 A 8/1999 Esser
5,965,517 A 10/1999 Mooney
5,966,831 A 10/1999 Anderson
5,968,404 A 10/1999 Trinh et al.
5,980,583 A 11/1999 Staub et al.
5,997,759 A 12/1999 Trinh et al.
6,001,343 A 12/1999 Trinh et al.
6,067,723 A 5/2000 Lafrenz
6,103,678 A 8/2000 Masschelein et al.
6,160,110 A 12/2000 Thomaides et al.
6,277,810 B2 8/2001 Baines et al.
6,279,834 B1 8/2001 Fox et al.
6,315,800 B1 11/2001 Gomes et al.
6,376,455 B1 4/2002 Friedi et al.
6,474,563 B2 11/2002 Pletcher et al.
6,491,840 B1 12/2002 Frankenbach et al.
6,495,058 B1 12/2002 Frankenbach et al.
6,503,413 B2 1/2003 Uchiyama et al.
6,571,993 B2 6/2003 Rodd et al.
6,574,883 B2 6/2003 Giblin et al.
6,604,297 B2 8/2003 Hagemann et al.
6,609,311 B2 8/2003 Hagemann et al.
6,696,405 B2 2/2004 Mooney
6,792,695 B2 9/2004 Fry et al.
6,883,723 B2 4/2005 Griese et al.
6,889,399 B2 5/2005 Steiner et al.
7,059,065 B2 6/2006 Gerlach et al.
7,146,749 B2 12/2006 Barron et al.
2001/0036909 A1 11/2001 Levinson
2001/0044399 A1 11/2001 Keppie et al.
2001/0052551 A1 12/2001 Pletcher et al.
2001/0052552 A1 12/2001 Hamaguchi et al.
2002/0050073 A1 5/2002 Hagemann et al.
2002/0069465 A1 6/2002 Chute et al.
2002/0078589 A1 6/2002 Hagemann et al.
2002/0083615 A1 7/2002 Giblin et al.
2002/0100122 A1 8/2002 Rodrigues et al.
2002/0112293 A1 8/2002 Trinh et al.
2003/0035748 A1 2/2003 Trinh et al.
2003/0091749 A1 5/2003 France et al.
2003/0196348 A1 10/2003 Hagemann et al.
2003/0199416 A1 10/2003 Fry et al.
2003/0199417 A1 10/2003 Fry et al.
2003/0200674 A1 10/2003 Fry et al.
2003/0213145 A1 11/2003 Hagemann et al.
2003/0224965 A1 12/2003 Conley et al.
2004/0064970 A1 4/2004 Hagemann et al.
2004/0118014 A1 6/2004 Burgess et al.
2004/0123489 A1 7/2004 Pancheri et al.
2004/0123490 A1 7/2004 Pancheri et al.
2004/0134090 A1 7/2004 Heilman et al.
2004/0134094 A1 7/2004 Hahn et al.
2004/0221476 A1 11/2004 Jones et al.
2004/0253376 A1 12/2004 Parker
2004/0259750 A1 12/2004 DuVal et al.
2005/0020478 A1 1/2005 Cooke et al.
2005/0022311 A1 2/2005 Zhang et al.
2005/0076453 A1 4/2005 Lucas et al.
2005/0076532 A1 4/2005 Ward et al.
2005/0076533 A1 4/2005 Huston et al.
2005/0076534 A1 4/2005 Ofosu-Asante et al.
2005/0120584 A1 6/2005 DuVal et al.
2005/0251924 A1 11/2005 DuVal et al.
2006/0080860 A1 4/2006 Clark et al.
2006/0162180 A1 7/2006 Heilman et al.
2006/0191157 A1 8/2006 Gerlach et al.
2007/0000068 A1 1/2007 France et al.
2007/0000291 A1 1/2007 France et al.

FOREIGN PATENT DOCUMENTS

EP 0 130 682 1/1985
EP 0 118 313 5/1987
EP 0 315 879 B1 5/1989
EP 0 204 484 B1 3/1992
EP 0 594 154 A1 4/1994
EP 0 848 999 A2 6/1998
EP 0 676 497 B1 9/1999
EP 0 953 669 A2 11/1999
EP 1 479 757 A1 11/2004
GB 2 066 309 A 7/1981
GB 2 231 944 A 11/1990
GB 2 354 006 B 3/2001
GB 2 366 568 A 3/2002
GB 2 346 678 B 10/2002
JP 02-302300 12/1990
JP 06-015090 1/1994
JP 1995068094 A2 3/1995
JP 08-150293 6/1996
JP 1996215488 A 8/1996
JP 09-267000 A 10/1997

| | | | |
|---|---|---|---|
| JP | 10-290898 | A | 11/1998 |
| JP | 2002069832 | A2 | 3/2002 |
| JP | 2002115182 | A | 4/2002 |
| WO | WO 96/09430 | | 3/1996 |
| WO | WO 99/55952 | A1 | 11/1999 |
| WO | WO 99/55953 | A1 | 11/1999 |
| WO | WO 00/01421 | A1 | 1/2000 |
| WO | WO 00/01422 | A1 | 1/2000 |
| WO | WO 00/01493 | A1 | 1/2000 |
| WO | WO 00/11133 | | 3/2000 |
| WO | WO 00/24851 | A2 | 5/2000 |
| WO | WO 00/24856 | A1 | 5/2000 |
| WO | WO 00/24858 | A1 | 5/2000 |
| WO | WO 00/38512 | A1 | 7/2000 |
| WO | WO 00/55292 | | 9/2000 |
| WO | WO 00/58428 | | 10/2000 |
| WO | WO 01/07710 | A1 | 2/2001 |
| WO | WO 01/18145 | A2 | 3/2001 |
| WO | WO 01/66264 | A1 | 9/2001 |
| WO | WO 02/08510 | A1 | 1/2002 |
| WO | WO 01/12423 | A2 | 2/2002 |
| WO | WO 02/33161 | A1 | 4/2002 |
| WO | WO 02/40623 | A2 | 5/2002 |
| WO | WO 03/004170 | A1 | 1/2003 |
| WO | WO 03/008528 | A1 | 1/2003 |
| WO | WO 03/087286 | A1 | 10/2003 |
| WO | WO 03/087461 | A1 | 10/2003 |
| WO | WO 03/102289 | A1 | 12/2003 |
| WO | WO 2004/099489 | A2 | 11/2004 |
| WO | WO 2006/006016 | A1 | 1/2006 |

OTHER PUBLICATIONS

U.S. Appl. No. 10/762,152, filed Jan. 21, 2004, DuVal et al.

International Critical Tables of Numerical Data, Physics, Chemistry and Technology, National Research Council of the United States of America, Edward W. Washburn, editor in chief, first electronic edition, published by Knovel, Norwich, New York, 2003, pp. 148-162.

Handbook of Chemistry and Physics, 3rd electronic edition, following the 81st printed edition, David R. Lide, editor-in-chief, published by CRC Press, Inc. 2000, Boca Raton, Florida, pp. 5-102 to 5-103, 5-4 to 5-88.

Perry's Chemical Engineer's Handbook, seventh edition, following the 81st printed edition, published by McGraw-Hill, ISBN 0-07-049841-5, 1997, pp. 2-187 to 2-195.

Brokaw, Leslie—"Get a Whiff Of This", Inc.com Magazine, Nov. 1988, (1 page) Copyright 2003 Gruner + Jahr USA Publishing, Inc.com, 77 North Washington Street, Boston, MA 02114.

StainsFile—"Classification of Dyes"; "Basic Dyes"; "Direct Dyes"; "Acid Dyes"; Comparison of Dye Structure; "Structure and Colour in Dyes"; (16 pages). Internet Website http://members.pgonline.com/~bryand/StainsFile/dyes/class/dyeclass.htm, Nov. 2002.

Innovative Packaging Network—"Clean-Clic®" (1 page). Internet Website www.ipneurope.com/Componentright1.html.

Medlin, Jennifer—"Microban, Germ Warfare", Environmental Health Perspectives v.105, n.3, Mar97 (5 pages). Internet Website www.mindfully.org/Plastic/Microban-Germ-Warfare.htm.

Exair-Mail Newsletter—Winter 2002-03 (2 pages). Exair Corporation, 1250 Century Circle North, Cincinnati, Ohio, 45246-3309.

Fyffe, Matt—Technical Report—"Recent Developments in Long-Range Static Elimination", Jun. 2003 (3 pages). Meech Static Eliminators, USA, Richfield, Ohio, Internet Website www.meech.com.

Quantum Research Group "Capacitance Explained" printed Nov. 18, 2004 (3 pages). Internet Website www.qprox.com/background/capacitance.php.

* cited by examiner

FABRIC ARTICLE TREATING SYSTEM AND METHOD

CROSS REFERENCE TO RELATED APPLICATIONS

This application is a continuation of U.S. Ser. No. 10/842,926, entitled "Fabric Article Treating System and Method", filed on May 11, 2004 now U.S. Pat. No. 7,047,663; which claims the benefit of U.S. Provisional Application Ser. No. 60/568,771 entitled "Uniform Delivery of Compositions", filed on May 6, 2004 and is a continuation-in-part of U.S. Ser. No. 10/839,549 entitled "Processes and Apparatuses for Applying a Benefit Composition to One or More Fabric Articles During a Fabric Enhancement Operation", filed on May 5, 2004; which is a continuation-in-part of U.S. Ser. No. 10/762,152, entitled "Volatile Material Delivery Method", filed on Jan. 21, 2004; which is a continuation-in-part of U.S. Ser. No. 10/697,736, entitled "Fabric Article Treating Method and Device Comprising a Heating Means", filed on Oct. 29, 2003; U.S. Ser. No. 10/697,734, entitled "Thermal Protection of Fabric Article Treating Device", filed on Oct. 29, 2003; U.S. Ser. No. 10/697,685, entitled "Fabric Article Treating Device Comprising More Than One Housing", filed on Oct. 29, 2003 now U.S. Pat. No. 7,043,855; and U.S. Ser. No. 10/697,735, entitled "Fabric Article Treating Apparatus with Safety Device and Controller", filed Oct. 29, 2003 now U.S. Pat. No. 7,146,749; each of which is a continuation-in-part of U.S. Ser. No. 10/418,595, entitled "Fabric Article Treating Method and Apparatus", filed on Apr. 17, 2003 now U.S. Pat. No. 7,059,065, which claims the benefit of U.S. Provisional Application Ser. No. 60/374,601, filed Apr. 22, 2002 and U.S. Provisional Application Ser. No. 60/426,438, filed Nov. 14, 2002.

FIELD OF INVENTION

The present invention relates to systems and methods useful for treating a fabric article with a composition comprising polyol-based fabric care materials and a dispersing medium. The dispersing medium is a liquid at room temperature and has a flash point of greater than about 65° C. Specifically, the composition may be dispensed to treat fabric articles in an appliance during the fabric article drying process.

BACKGROUND OF THE INVENTION

Fabric article treating methods and/or apparatuses have been evolving over the past 20 years. For example, technologies relating to fabric treatment compositions and/or dispensing devices suitable for use in a tumble dryer are disclosed in U.S. Pat. No. 4,207,683; U.S. Patent Publications 2003/0200674A1; 2003/0213145A1; and PCT Publication WO 03/087286A1.

There exists a continuing need to develop a fabric article treating methods and/or systems, especially for in-home fabric article treating applications in the drying cycle that improves and/or enhances the deposition of fabric article actives onto fabric articles being treated. There also exists a continuing need to develop fabric treatment compositions having characteristics (such as viscosity-temperature profile, flash point, odor) suitable for use in those fabric article treating method and/or systems. Moreover there exists a continuing need to develop fabric treatment compositions that are comfortable against the skin and that does not yellow with repeated use.

SUMMARY OF THE INVENTION

One aspect of the present invention relates to a fabric article treating system comprising:

(a) a fabric article drying appliance; and (b) a fabric article treating device removably attached to said drying appliance, said treating device comprising a source for containing a fabric treatment composition and means for dispensing said composition in said drying appliance, said means is in liquid communication with said source;

wherein said composition comprises a polyol-based fabric care material and a dispersing medium.

In another aspect of the invention, methods for treating a fabric article with a composition comprising polyol-based fabric care materials in a fabric article drying appliance are also provided.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE INVENTION

Definitions

Figure 1:
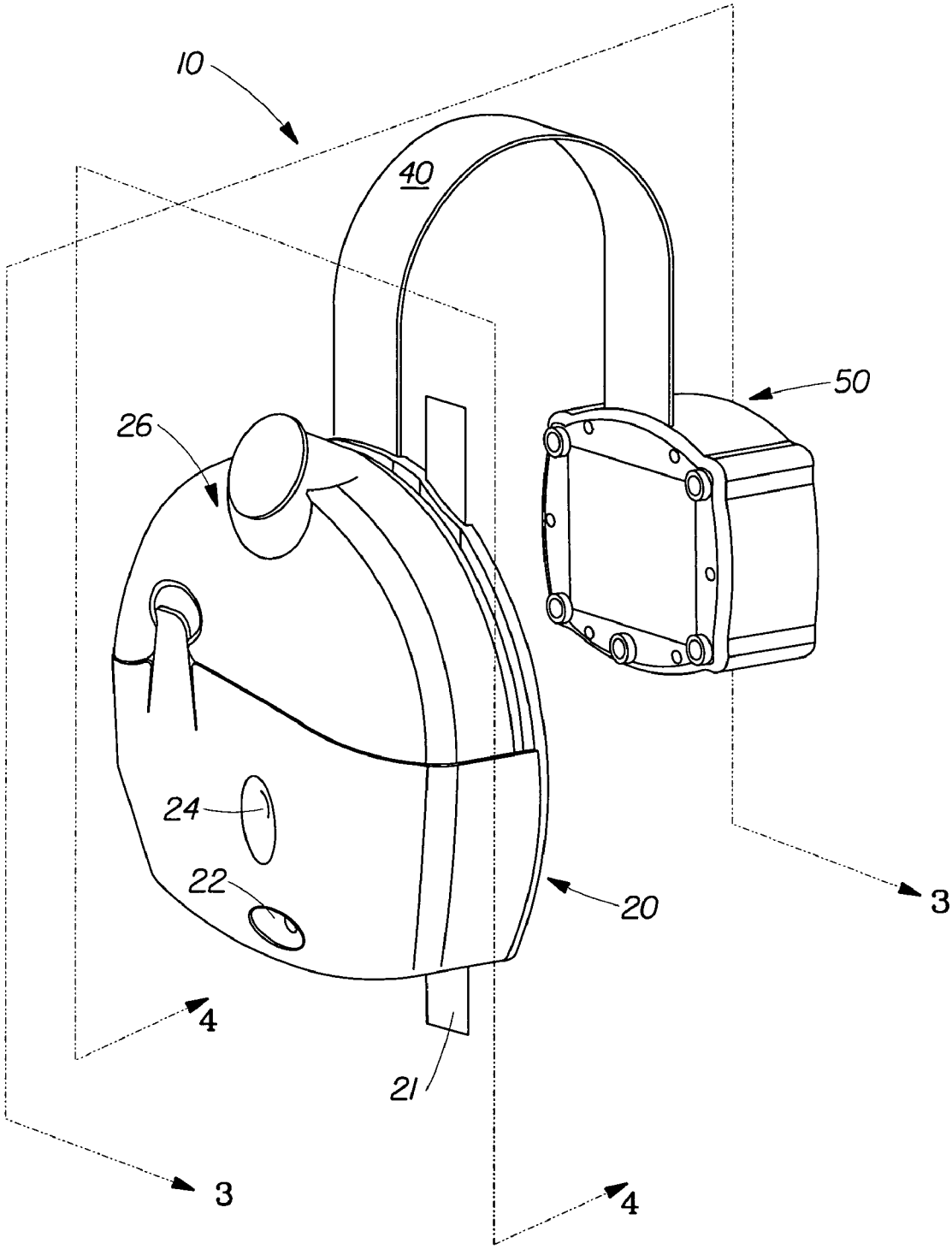
FIG. 1 is a perspective view of an embodiment for a stand-alone fabric article treating apparatus that is constructed according to the principles of the present invention.

As used herein, "fabric article" means an article composed of fabrics and/or fibers. Such articles include, but are not limited to, clothing, towels and other bath linens, bed linens, table cloths, carpets, curtains, upholstery coverings, sleeping bags, tents, shoes, and car interior (such as car seat covers, car floor mats).

As used herein, "during a drying cycle" means while the dryer is operating.

As used herein, "fabric care material" means a material or combination of materials that can deliver one or more of the following benefits to a fabric article; softening, crispness, water and/or stain repellency, refreshing, antistatic, anti-shrinkage, anti-microbial, durable press, wrinkle resistance, odor resistance, abrasion resistance, anti-felting, anti-pilling, appearance enhancement, and mixtures thereof.

As used herein, "fabric treatment composition" means a composition that comprises one or more fabric care materials, or one or more perfume materials, or combinations thereof. Suitable forms of treatment compositions include, but are not limited to, fluidic substances, such as liquids or gases, and solid compounds, such particles or powders.

As used herein, the terms "treatment composition", "fabric treatment composition" and "benefit composition" are synonymous.

As used herein, the articles "a" and "an", when used in a claim, are understood to mean one or more of the material that is claimed or described.

Unless otherwise noted, all component or composition levels are in reference to the active level of that component or composition, and are exclusive of impurities, for example, residual solvents or by-products, which may be present in commercially available sources.

Unless otherwise indicated, all percentages and ratios are calculated based on weight of the total composition.

Treating System and Delivery Method

In one aspect of Applicants' invention, a fabric treatment composition that is applied by processes including, but not limited to, spraying, to a fabric article, wherein the treatment composition comprises one or more polyol-based fabric care materials.

In another aspect of Applicants' invention, the treatment composition that is applied by processes including, but not limited to, spraying, to a fabric article can be a composition comprising a polyol-based fabric care material, a dispersing medium, and optionally, one or more adjunct materials, such as fabric care materials or other adjuncts.

In a further aspect of Applicants' invention, the treatment composition is applied to a fabric article by a treating system that is configured to deliver, such as spraying, or otherwise release the treatment composition into a receiving volume, which could be the drum (or other chamber) of a clothes drying appliance, within which a fabric article is treated.

The treating system would typically comprise: a drying appliance comprising a drum in which the fabric article is deposited and treated; a housing or enclosure, such as a reservoir, that contains a source of the fabric treatment composition, or is in communication with an external source of the fabric treatment composition; a dispensing device that provides the means for releasing or dispensing the fabric treatment composition, such as a nozzle; a controller, such as an electronic control device with a processing circuit, and input and output circuits; one or more sensors, such as a temperature sensor or a vapor and/or gas sensor; one or more input devices, such as a start switch and/or a keypad; one or more indicating devices, such as color lights or LED's; and optionally, a charging system, if the fabric treatment composition is to be electrostatically charged before (or while) being delivered. Details of the electrostatically charged spraying apparatus and method are disclosed in U.S. Patent Publication No. 2004/0025368A1 filed Apr. 17, 2003.

Reference will now be made in detail to suitable non-limiting embodiments of the treating system for delivering a fabric treatment, an example of which is illustrated in the accompanying drawings, wherein like numerals indicate the same elements throughout the views. Other treating systems suitable for use herein are disclosed in U.S. Pat. No. 4,207,683; U.S. Patent Publications Nos. 2003/0200674A1; 2003/0213145A1; 2004/0025368A1; and U.S. patent application Ser. Nos. 10/697,685 and 10/697,736.

Figure 3:
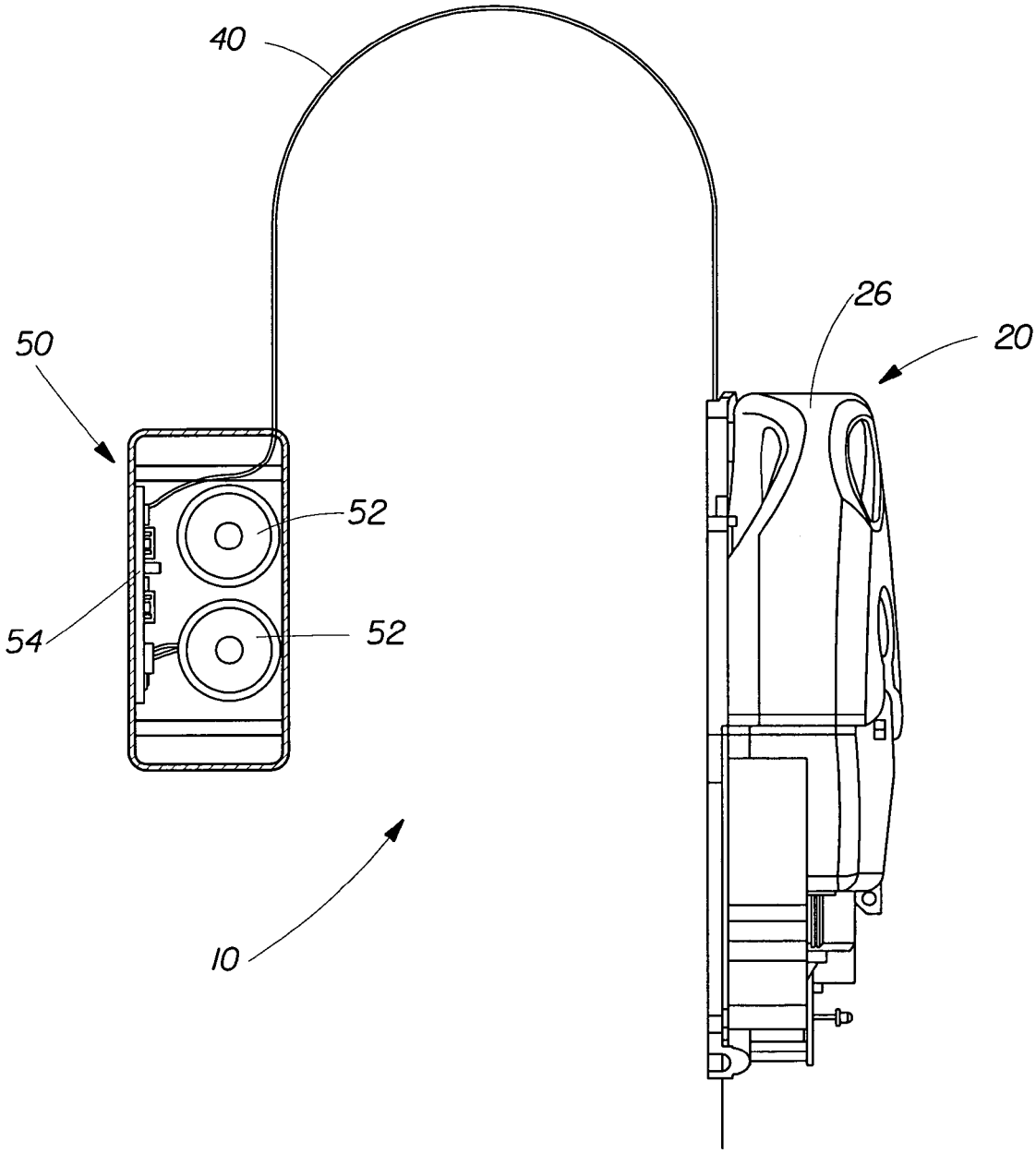
FIG. 3 is an elevational view from one end in partial cross-section of the fabric article treating apparatus of FIG. 1, illustrating the internal housing and external housing, as joined together by a flat cable.
Figure 4:
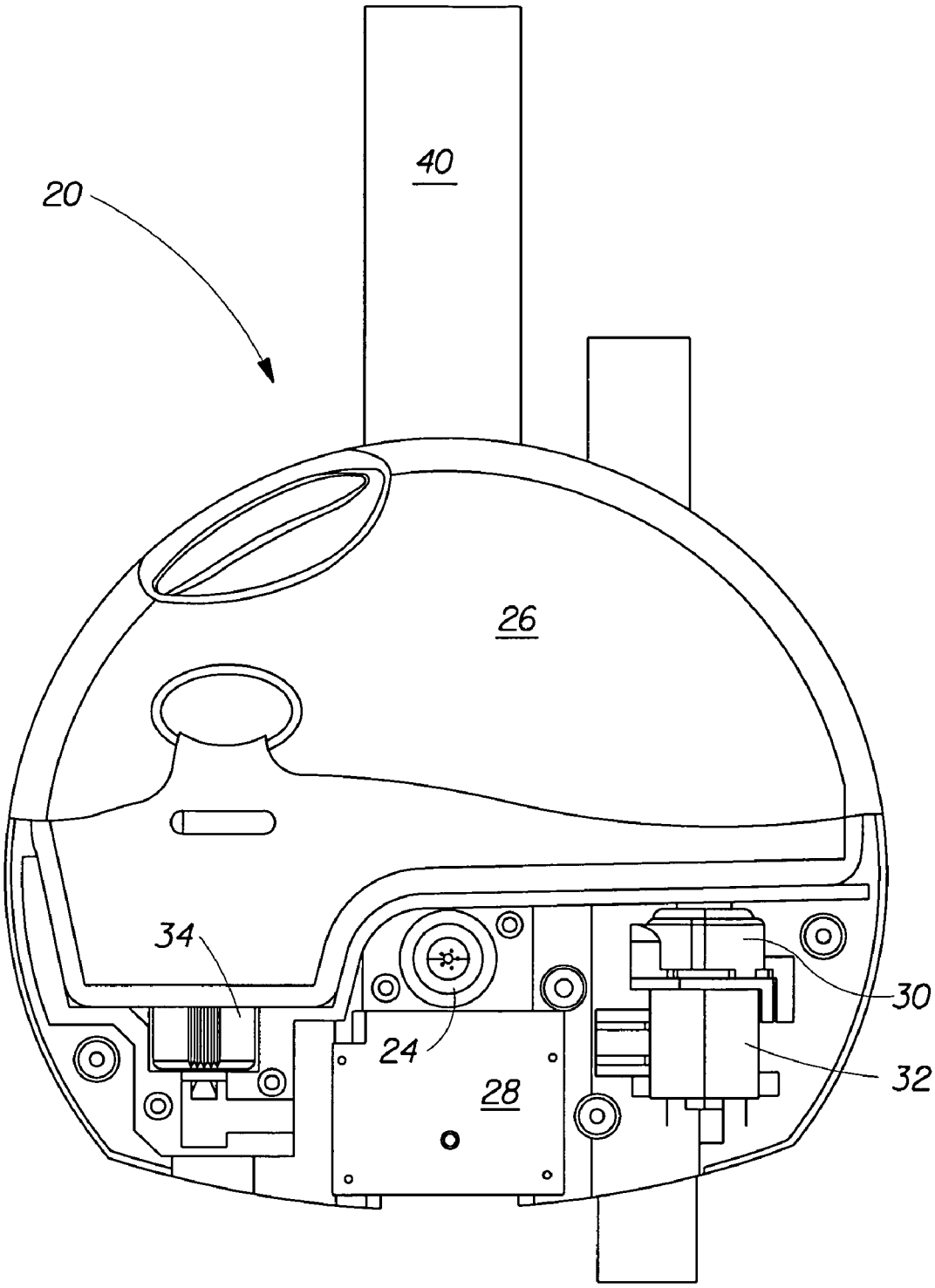
FIG. 4 is an elevational view from one side in partial cross-section of the internal housing portion of the fabric article treating apparatus of FIG. 1.
Figure 5:
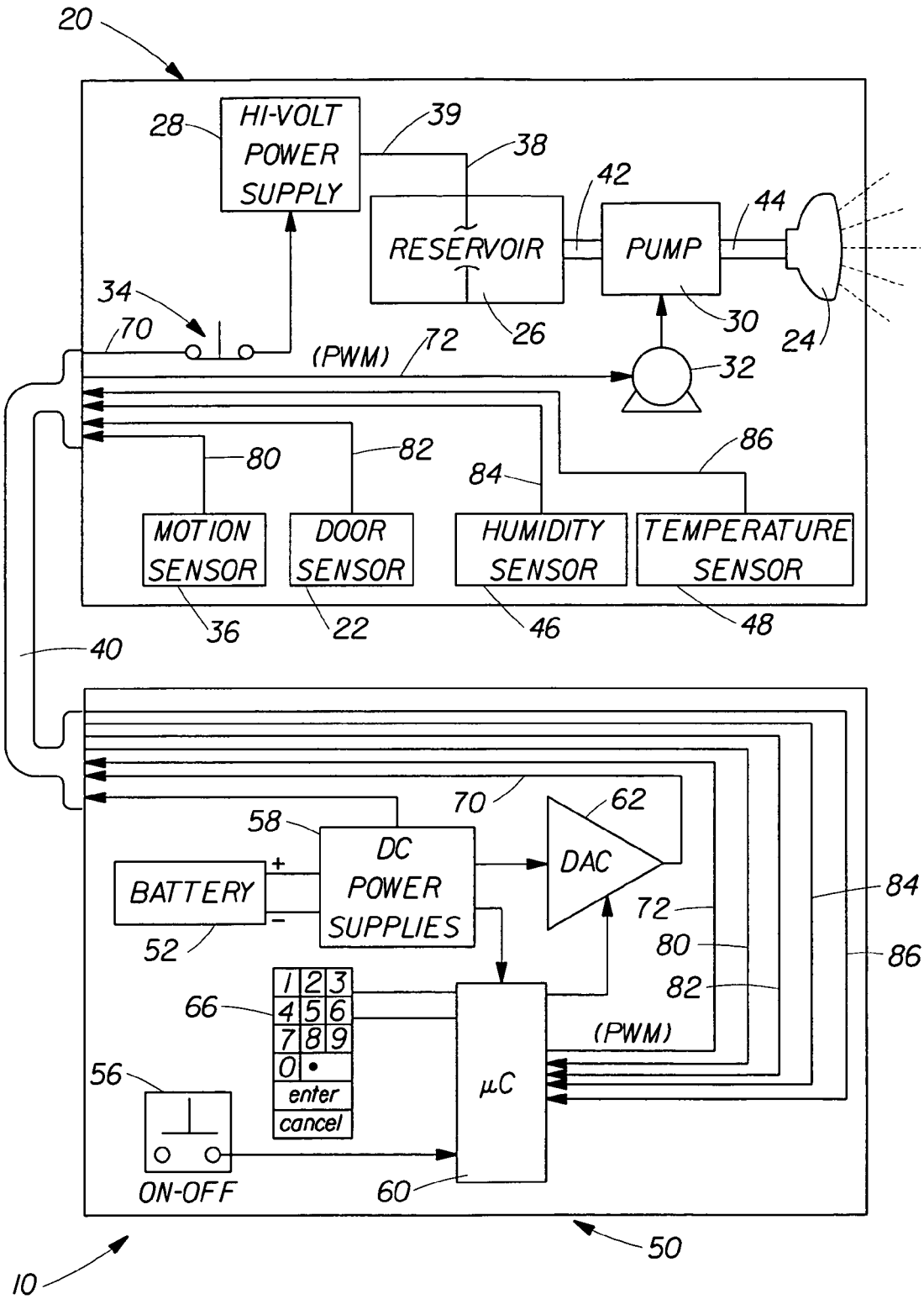
FIG. 5 is a block diagram of some of the electrical and mechanical components utilized in the fabric article treating apparatus of FIG. 1.

FIGS. 1-4 illustrate one embodiment of an exemplary fabric article treating system for use in the present invention, while FIG. 5 depicts one embodiment of a suitable controller, and other electrical and electronic devices for use in the present invention.

Referring now to the embodiment of FIG. 1, a "stand-alone" controller and dispenser unit (i.e., as a self-contained device), generally designated by the reference numeral 10, is illustrated as having two major enclosures (or housings) 20 and 50. In this embodiment, the enclosure 20 acts as an "inner housing" which is located in the interior of a fabric article drying appliance (e.g., a clothes dryer), while the enclosure 50 acts as an "outer housing" that is located in the exterior of the fabric article drying appliance. The enclosure 50 may be mounted on the exterior surface of the fabric article drying appliance door, however, it may instead be mounted on any exterior surface, non-limiting examples of which include: the side walls, the top walls, the outer surface of a top-opening lid, and the like, including a wall or other household structure that is separate from the fabric article drying appliance. Furthermore, the enclosure 20 may be mounted on any interior surface of the fabric article drying appliance, examples of which include, but are not limited to: the interior surface of the door, the drum of the fabric article drying appliance, the back wall, the inner surface of a top-opening lid, and the like.

Figure 6:
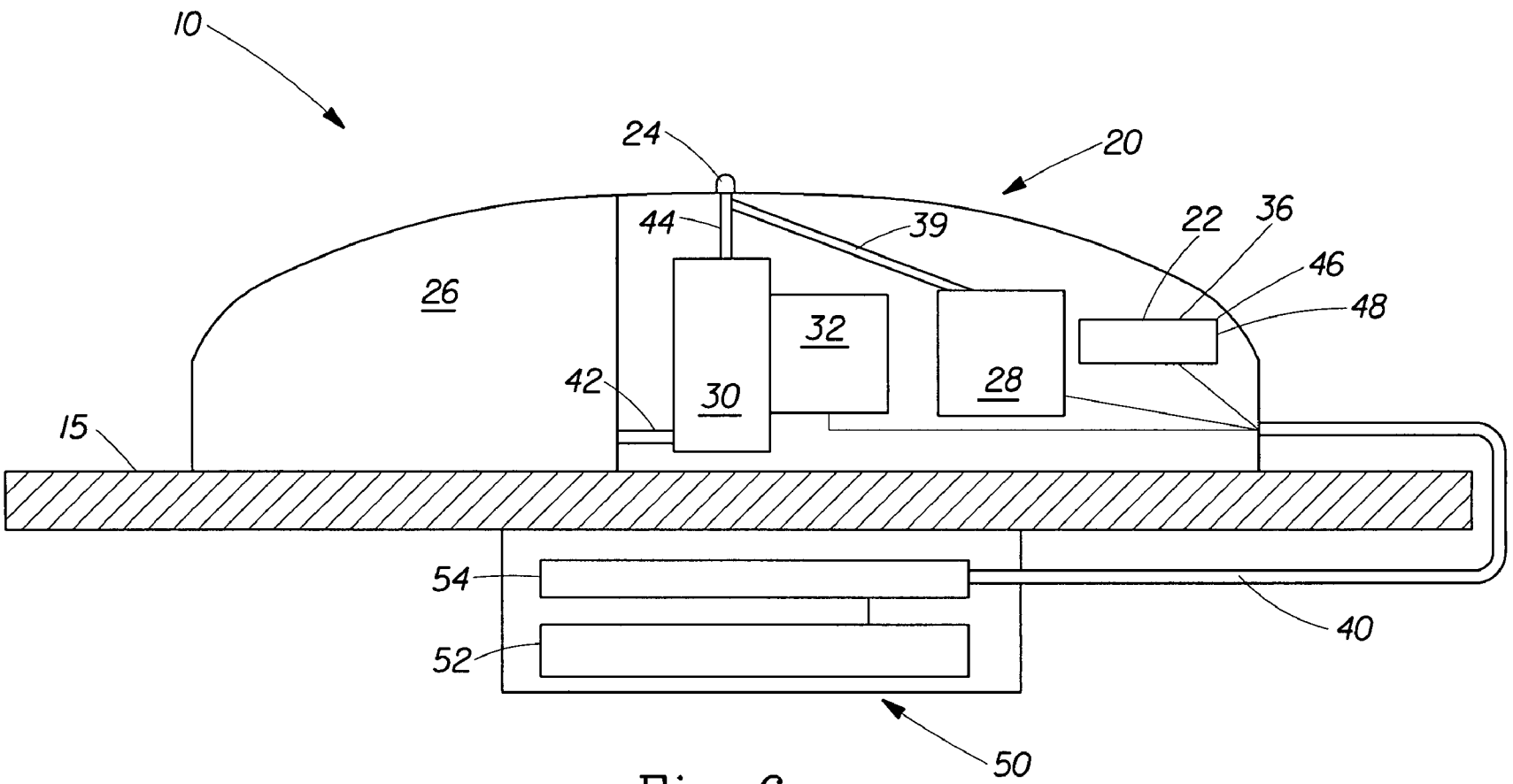
FIG. 6 is a diagrammatic view in partial cross-section of the fabric article treating apparatus of FIG. 1, as it is mounted to the door of a clothes dryer apparatus.

Enclosure 50 may be permanently mounted to the exterior surface, or preferably releasably attached to the exterior surface. Likewise, enclosure 20 may be permanently mounted to the interior surface, or releasably attached to the interior surface. One configuration for such an attachment is illustrated in FIG. 6, in which the door of the drying appliance is generally designated by the reference numeral 15.

When mounted on the interior surface of the door, for example, the enclosure 20 may be constructed so as to have the appearance of being "permanently" mounted, such that it seems to be "built into" the door of a dryer unit (or other type of fabric article drying appliance), without it actually being truly constructed as part of the fabric article drying appliance. On the other hand, enclosure 20 perhaps may be more loosely mounted near the door, or along side the interior surface of the door, much like one of the embodiments 10 as depicted in FIGS. 1-4 that "hangs" along a vertical door of the appliance. It will be understood that the term "door," as used herein, represents a movable closure structure that allows a person to access an interior volume of the dryer apparatus, and can be of virtually any physical form that will enable such access. The door "closure structure" could be a lid on the upper surface of the dryer apparatus, or a hatch of some sort, or the like.

It should be noted that the treating apparatus 10 may be grounded by way of being in contact with a grounded part of the fabric article drying appliance such as by a spring, patch, magnet, screw, or other attaching means, and/or by arc corona discharge, or by way of dissipating residual charge. Non-limiting examples of suitable methods for dissipating charge are disclosed in U.S. Patent Publication No. 2004/0025368.

In FIG. 1, a discharge nozzle 24 and a "door sensor" 22 are visible on the inner housing 20, which also includes a benefit composition-holding reservoir 26 within an interior volume of the inner housing 20. The reservoir 26 may be used to hold a benefit composition. The discharge nozzle 24 can act as a fluid atomizing nozzle, using either a pressurized spray or, along with an optional high voltage power supply (not shown in FIG. 1) it can act as an electrostatic nozzle. One suitable example of a fluid atomizing nozzle is a pressure swirl atomizing nozzle. Non-limiting examples of suitable nozzles include the Cosmos 13 NBU nozzle manufactured by Precision Valve Corporation of Marietta, Ga., the WX12 and WD32 nozzles manufactured by Saint-Gobain Calmar USA, Inc. of City of Industry, Calif., and Seaquist Model No. DU-3813 manufactured by Seaquist Dispensing of Cary, Ill. The nozzle may be permanently attached or releaseably attached to the treating device. One non-limiting example of a releaseably attached nozzle is a nozzle which is threaded such that it can easily be removed from or placed in the treating device. The nozzle may be disposable.

A spray nozzle or a fluid atomizing nozzle typically provides an average droplet size that is less than about 1000 microns, typically from about 100 to about 1000 microns, or from about 120 to about 500 microns, or from about 150 to about 300 microns. This average droplet size is measured by a Malvern particle analyzer. When a spray nozzle is covered with a fine grid or a membrane to produce a finer mist of droplets with an average particle size of less than 100 microns.

Nebulizers, atomizers and like devices are well known to those skilled in the art. A suitable device for use herein is a nebulizer that has at least one ultrasonic sonotrode, or ultrasonic vibrating cell. Typical of such nebulizer is commercially available under the tradename Acu Mist® from Sono Tek Corporation, Milton, N.Y. Still other examples of such devices are available from Omron Health Care, GmbH, Germany; and from Flaem Nuove, S.P.A, Italy. Likewise, aerosol delivery systems, which are well known to the art, can be used to deliver the detergent and/or finishing compositions. The benefit composition can comprise a fluidic substance, such as a liquid or a gaseous compound, or it can comprise a solid compound in the form of particles, such as a powder, or solid particles in solution with a liquid.

Reservoir 26 can be of essentially any size and shape, and could take the form, for example, of a pouch or a cartridge; or perhaps the reservoir could be connected to a source of dispersing medium (for example, a household water line for situations in which the benefit composition comprises potable water) such that the benefit composition in the reservoir can be diluted to the desired viscosity and/or surface tension.

The inner housing 20 and outer housing 50 are typically in electrical communication. In the embodiment of FIG. 1, a flat cable 40 (also sometimes referred to as a "ribbon cable") is run between the two housings 20 and 50, and travels along the inner surface of the fabric article drying appliance door 15 (see FIG. 6, for example), over the top of the door 15, and down the exterior surface of the door 15.

Figure 2:
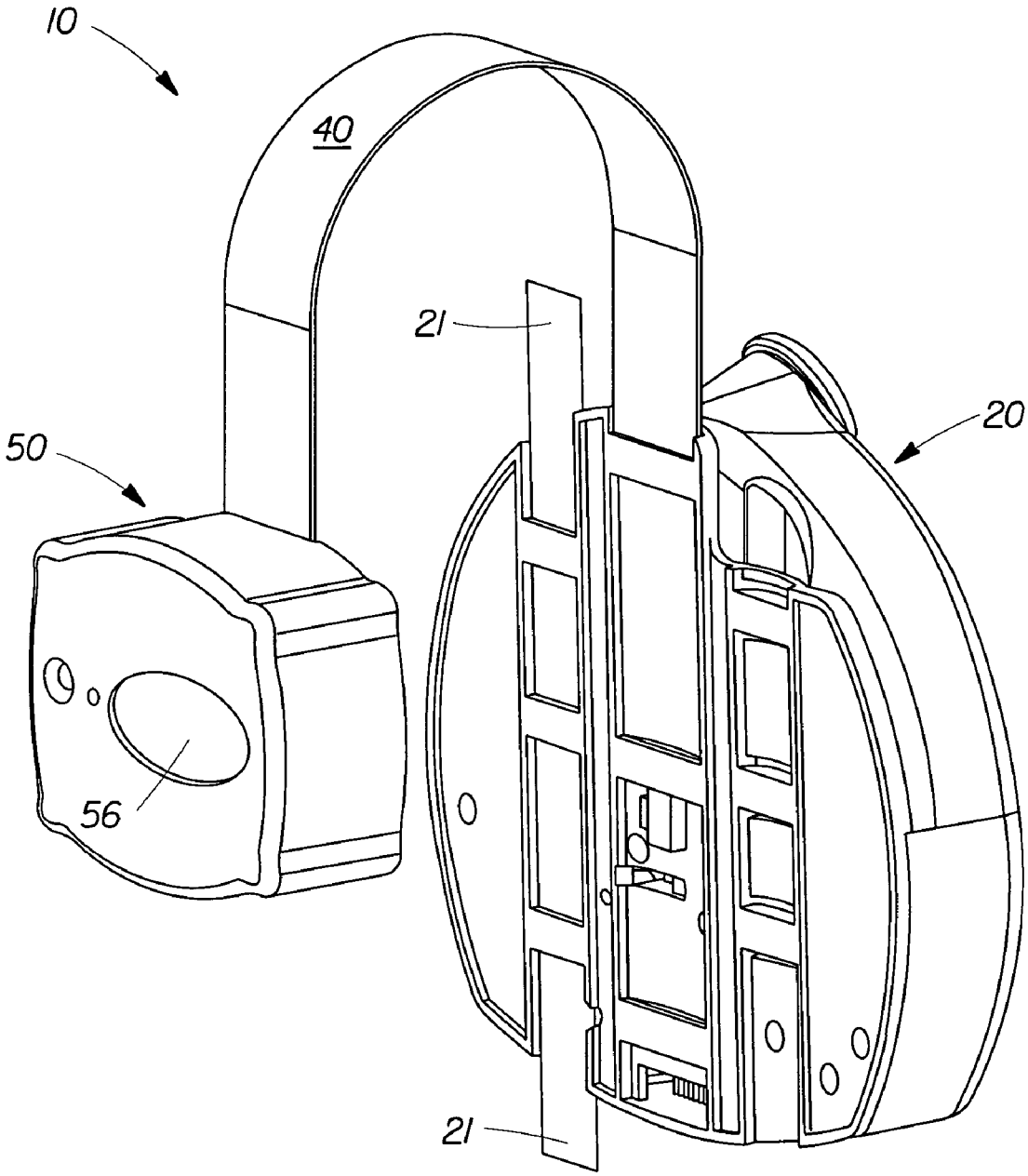
FIG. 2 is a perspective view from the opposite angle of the fabric article treating apparatus of FIG. 1.

FIG. 2 shows the same fabric article treating apparatus 10 from an opposite angle, in which the outer housing 50 is provided with an ON-OFF switch at 56. The flat cable 40 is again visible in FIG. 2, and along the surface of the inner housing 20 visible in FIG. 2, a door mounting strap 21 is visible. An end of the mounting strap is also visible in FIG. 1. Certainly other arrangements for attaching the inner housing 20 to a dryer door 15 (or other interior surface) are available without departing from the principles of the present invention.

Referring now to FIG. 3, the fabric article treating apparatus 10 is illustrated such that the reservoir 26 can be seen as an interior volume of the inner housing 20. In the outer housing 50, a set of batteries 52 can be seen, as well as a printed circuit board with electronic components at 54. The electronic components of one embodiment will be discussed below in greater detail. It will be understood that any type of electrical power source could be used in the present invention, including standard household line voltage, or even solar power. Batteries may be utilized if it is desired to make the apparatus 10 easily portable, however, any appropriate power adapter can be provided to convert an AC power source to the appropriate DC voltage(s) used in the electronic components on the PC board 54, or to convert a DC power source (including a battery or solar panel) to the appropriate DC voltage(s) used in the electronic components on the PC board 54.

Referring now to FIG. 4, some of the other hardware devices are illustrated with respect to the inner housing 20. In the embodiment of FIG. 4, the discharge nozzle 24 acts as an electrostatic nozzle, and thereby is coupled with a high voltage power supply 28, by use of an electrical conductor not shown in this view. A quick disconnect switch 34 is included for safety purposes, so that the high voltage power supply 28 can be quickly shut down if necessary. A pump 30 and a corresponding electric motor 32 are visible in FIG. 4. Some type of pumping apparatus is used regardless as to whether the discharge nozzle 24 is producing a pressurized spray only, or an electrostatic spray that utilizes a high voltage power supply 28.

FIG. 5 provides a block diagram of some of the electrical and mechanical components that are included in a fabric article treating apparatus 10, as constructed according to one embodiment of the present invention. In this example embodiment, the high voltage power supply 28 is provided in the inner housing 20, which will be used to electrically charge the fluid that will be dispensed through the discharge nozzle 24, thus making this an electrostatic nozzle system. The inner housing 20 utilizes a general body or enclosure to contain the devices needed within the drying appliance, and it will be understood that such components will generally be subjected to relatively high temperatures during the treatment cycle of the drying appliance. Consequently, the more sensitive electronic components will generally (but not always) be mounted in a different location, such as in the outer housing 50.

The flat cable 40 will bring certain command signals and electrical power into the inner housing 20, and will also receive electrical signals from sensors mounted in the inner housing 20 and communicate those sensor signals back to the outer housing 50. A power supply control signal follows a wire 70 through the quick disconnect switch 34 to the high voltage power supply 28. This signal can comprise a constant DC voltage, a constant AC voltage, a variable DC voltage, a variable AC voltage, or some type of pulse voltage, depending on the type of control methodology selected by the designer of the fabric article treating apparatus 10.

In one embodiment, the signal at 70 is a variable DC voltage, and as this voltage increases, the output of the high voltage power supply 28 will also increase in voltage magnitude, along a conductor 39 (e.g., a wire) that is attached to an electrode 38 that carries the high voltage to the nozzle 24, or into the reservoir 26. The voltage impressed onto the electrode 38 will then be transferred into the benefit composition. A constant output voltage DC high voltage power supply could optionally be used instead of the variable output voltage power supply 28 of the exemplary embodiment.

Once the benefit composition is charged within the reservoir 26 it will travel through a tube or channel 42 to the inlet of the pump 30, after which the composition will be pressurized and travel through the outlet of the pump along another tube (or channel) 44 to the discharge nozzle 24. For use in the present invention, the actual details of the type of tubing used, the type of pump 30, and the type of electric motor 32 that drives the pump, can be readily configured for almost any type of pressure and flow requirements. The electrical voltage and current requirements of the electric motor 32 to provide the desired pressure and flow on the outlet of the pump 30 can also be readily configured for use in the present invention. Virtually any type of pump and electric motor combination can be utilized in some form or another to create a useful device that falls within the teachings of the present invention, or a stand-alone pump can be used (i.e., without an associated electric motor), as discussed below.

It should be noted that some types of pumps do not require separate input and output lines or tubes to be connected thereto, such as peristaltic pumps, in which the pump acts upon a continuous tube that extends through an inlet opening and continues through a discharge opening of the pump. This arrangement is particularly beneficial for use with electrostatically charged fluids or particles that are being pumped toward the discharge nozzle 24, because the tubing can electrically insulate the pump from the charged benefit composition. It should also be noted that an alternative pumping device could be used, if desired, such as a spring-actuated pumping mechanism. A non-limiting example of a suitable peristaltic pump is the Model 10/30 peristaltic pump, which may be obtained from Thomas Industries of Louisville, Ky.

The types of control signals used to control the electric motor 32 can vary according to the design requirements of the apparatus 10, and such signals will travel along an electrical conductor 72 to control motor 32, via the flat cable 40. If the motor 32 is a DC variable-speed motor, then a variable "steady" DC voltage can be applied, in which the greater the voltage magnitude, the greater the rotational speed of the motor. In one embodiment, the electrical signal traveling along conductor 72 can be a pulse-width modulated (PWM) signal, that is controlled by a microprocessor or a microcontroller. Of course, such a pulse-width modulated signal can also be controlled by discrete logic, including analog electronic components.

The fabric article treating apparatus 10 can be enhanced by use of certain sensors, examples of which include but are not limited to a door (or lid) sensor 22, a motion sensor 36, a humidity sensor 46, and/or a temperature sensor 48. An analog output temperature sensor can be used to provide an analog signal along the electrical conductor 86 that leads back to the controller in the outer housing 50.

The major components of the exterior housing 50 typically comprise the electronics 54 and the power source 52. For example, if power source 52 comprises four D-cell batteries connected in series, a +6 volt DC voltage will be provided to a set of DC power supplies generally designated by the reference numeral 58. It will be presumed that more than one DC power supply voltage will be required by the control circuit in the outer housing 50. One of the DC power supply voltages provides energy for the high voltage power supply 28, via the electrical conductor 70 that runs through the flat cable 40. Another output voltage is provided to a microcontroller 60, which in an exemplary embodiment requires a +3.3 volt DC power supply. In an exemplary embodiment, a digital-to-analog converter (DAC) 62 is used, and the device provided by Analog Devices of Norwood, Mass. (Part No. AD 5301), requires a +5 volt DC power supply. All of these power supplies are provided by the "set" of DC power supplies 58.

Part of the external housing 50 includes inputs to the microcontroller 60. One important element that could be used as a user interface to the microcontroller 60 would be a keypad 66, such as a set of bubble or membrane switches that have the numbers 0-9, as well as an "ENTER" key. Other keys could be included as part of keypad 66, including a "CANCEL" key, or perhaps a decimal point key.

FIG. 6 diagrammatically shows the general location of some of the components of one of the stand-alone embodiments of the fabric article treating apparatus 10 of the present invention. As discussed above, the electronics 54 and the batteries 52 are located within the outer housing 50, which is electrically connected to a flat cable 40 that carries power supply and input/output signals between the outer housing 50 and the inner housing 20.

Contained within the inner housing 20 are the reservoir 26, pump 30, electric motor 32, optional high voltage power supply 28, discharge nozzle 24, and various sensors that may or may not be included for a particular version of the treating apparatus 10. The electrical conductor 39 is depicted, which carries the high voltage to the nozzle 24, and this is one configuration that could be alternatively used instead of carrying the high voltage to the reservoir 26. The tubing 42 to the inlet of the pump is illustrated, as well as the tubing 44 from the outlet of the pump that provides the benefit composition to the nozzle 24. It should be noted that the high voltage power supply 28 is strictly optional within the teachings of the present invention; if spray droplets/particles emitted from the nozzle 24 are not to be electrostatically charged, then there is no need for a high voltage power supply within the inner housing 20.

Figure 7:
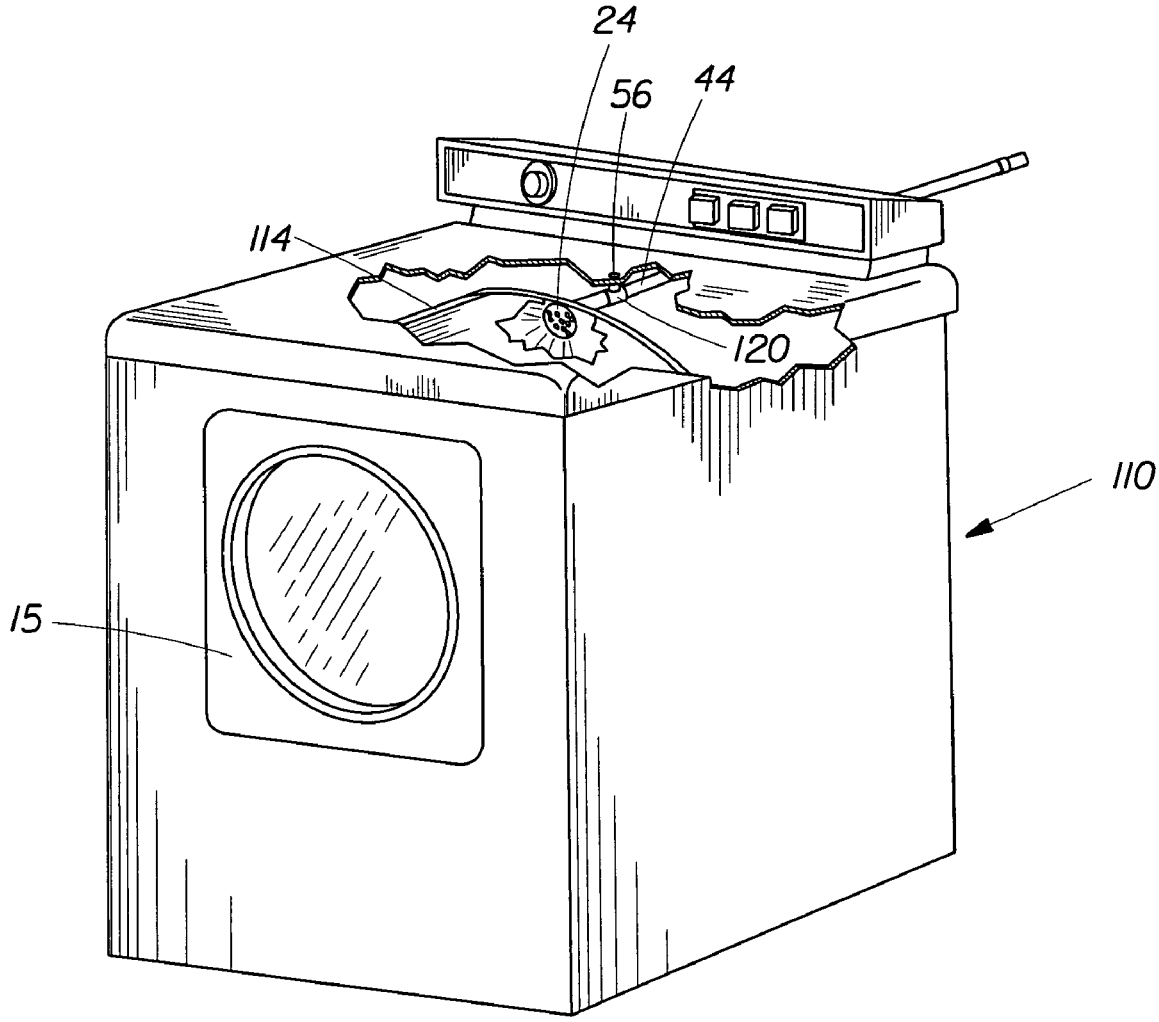
FIG. 7 is a perspective view of a fabric article drying appliance that has a nozzle which sprays a benefit composition into the drum portion of the dryer, as constructed according to the principles of the present invention.

FIG. 7 illustrates an alternative embodiment for use with the present invention, which depicts a fabric article drying appliance generally designated by the reference numeral 110. In this mode of the present invention, the controller depicted in the stand-alone embodiment of the earlier figures is now integrated into the electronic control system of the drying appliance 110. A door 15 is illustrated in FIG. 7, which is the normal point of access by a human user to the interior drum volume of the drying appliance 110. A nozzle 24 is used to direct a benefit composition into the drum area, in which the drum is generally designated by the reference numeral 114. A supply pipe 44 brings the benefit composition to the nozzle 24, through a control valve 120, that can have an ON/OFF push button 56, if desired.

In FIGS. 10-14, where like reference numerals indicate like elements, a benefit composition dispensing apparatus 1100 constructed in accordance with a third embodiment of the present invention is illustrated. The apparatus 1100 comprises two enclosures or housings 1120 and 1150. Enclosure 1120 defines an "inner housing" located in an interior of a fabric enhancement apparatus such as a fabric article drying appliance, e.g., a clothes dryer (not shown in FIGS. 10-14), while the enclosure 1150 defines an "outer housing" located outside of the fabric article drying appliance. The fabric enhancement apparatus may also comprise a laundry apparatus or a laundry and drying apparatus. The enclosure 1150 may be mounted on an exterior surface of the fabric enhancement apparatus door (not shown), such as by pressure sensitive, thermally stable adhesive foam strips (not shown). Alternatively, the enclosure 1150 may be mounted on any other exterior surface of the fabric enhancement apparatus, non-limiting examples of which include: side walls, top walls, an outer surface of a top-opening lid, and the like. The enclosure 1150 may also be mounted on a wall or other household structure that is separate from the fabric enhancement apparatus. Furthermore, the enclosure 1120 may be mounted, such as by pressure sensitive, thermally stable adhesive foam strips (not shown), on any interior surface of the fabric enhancement apparatus, examples of which include, but are not limited to: the interior surface of the door, a drum of the apparatus, the back wall, the inner surface of a top-opening lid, and the like.

Figure 8:
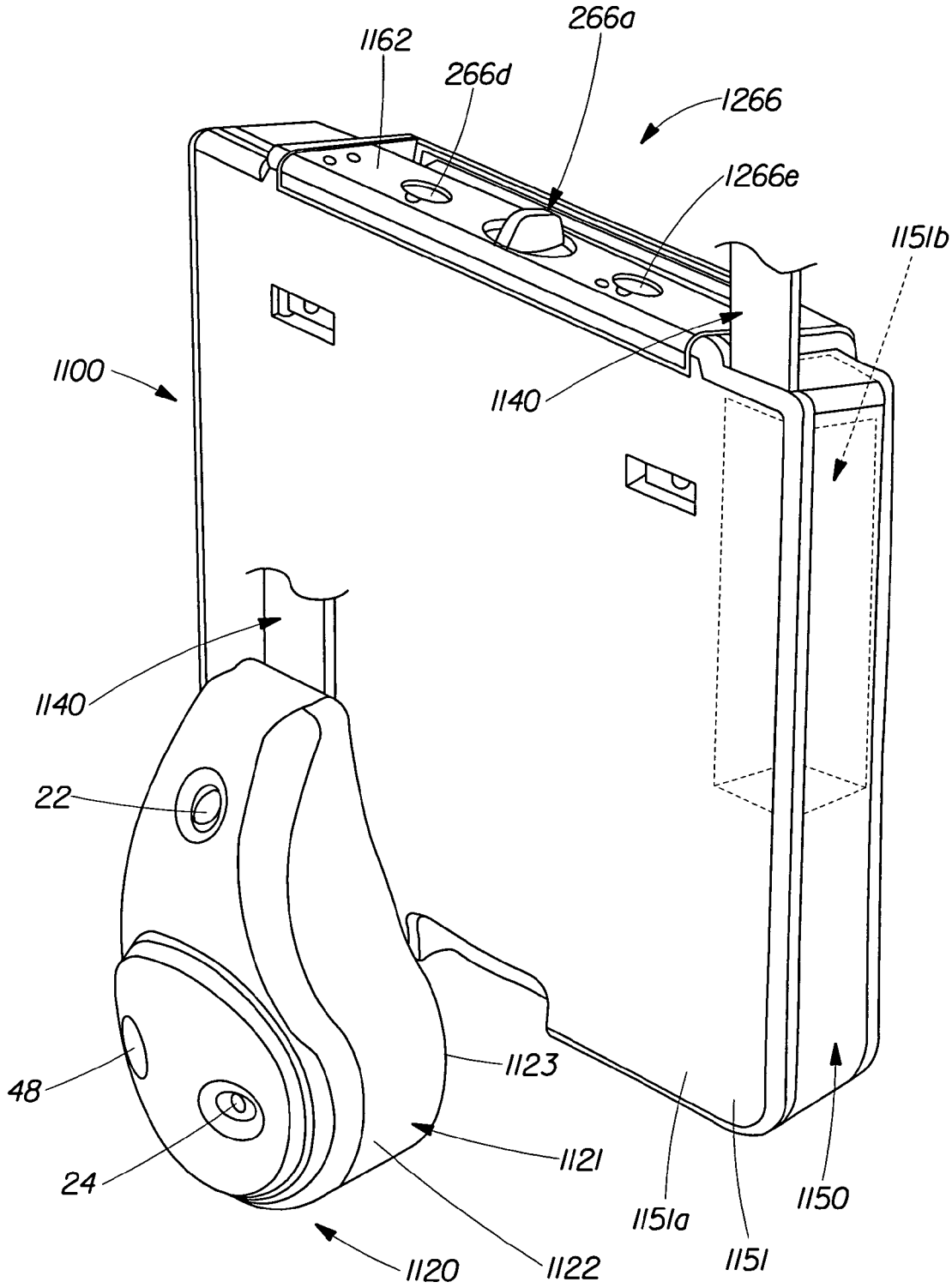
FIG. 8 is a perspective view of another embodiment of a stand-alone unit for dispensing a benefit composition constructed according to the principles of the present invention.
Figure 9:
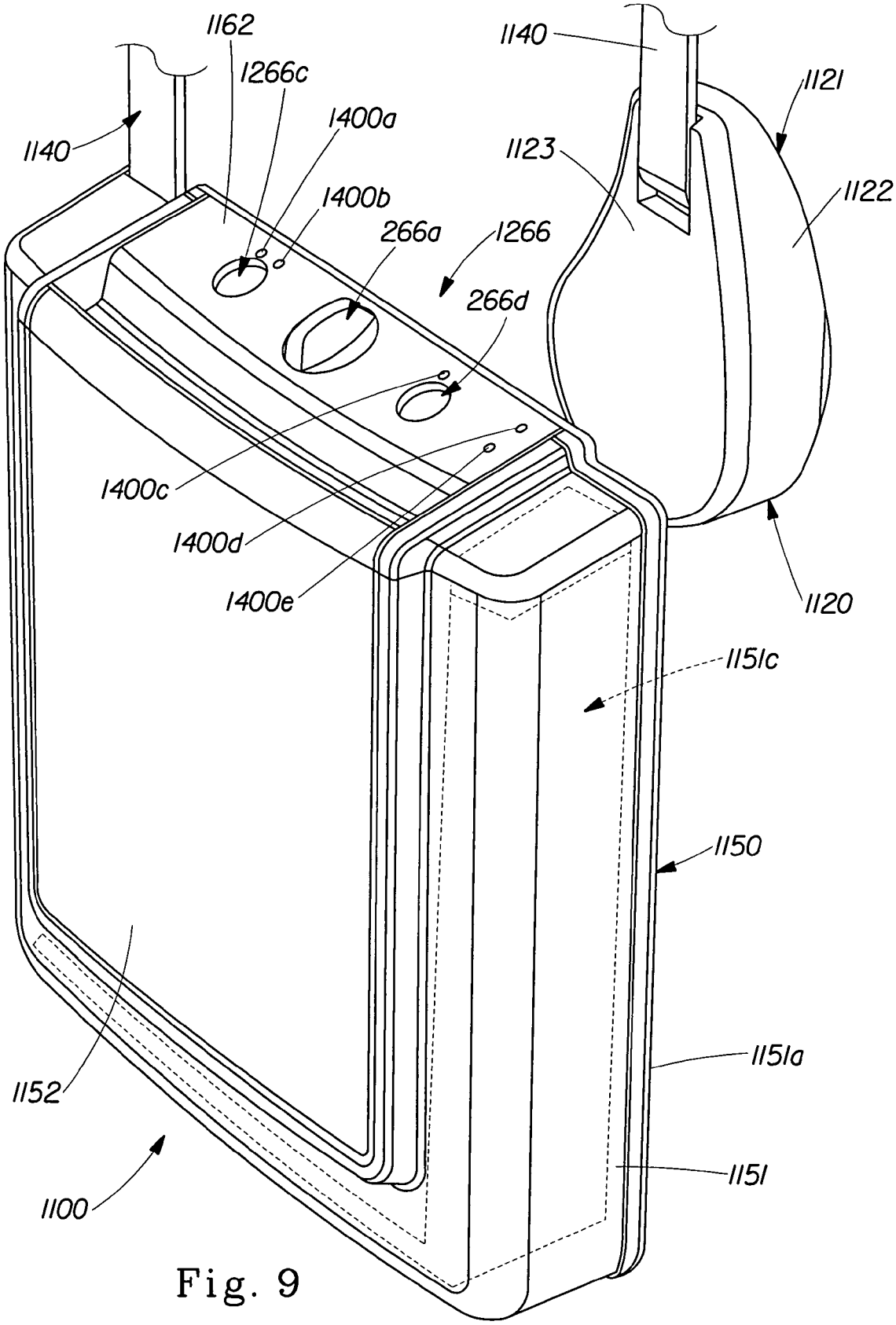
FIG. 9 is a perspective view from an opposite angle of the unit of FIG. 8.

As illustrated in FIGS. 8 and 9, the inner housing enclosure 1120 comprises a main body 1121 comprising an integral front/side main section 1122 and a back plate section 1123 secured to the main section 1122 via screws, adhesive, snap-fit elements or the like. The sections 1122 and 1123 are preferably molded from a polymeric material. Housed within the main body 1121 are the following elements: a discharge nozzle 24; a door sensor 22 for sensing ambient light when the door of the fabric enhancement apparatus is open such that the sensor 22 is exposed to ambient light; a motion sensor 36 (contained within the main body 1121 and not visible from outside the main body 1121); a humidity sensor 46; and a temperature sensor 48. In this embodiment, the nozzle 24 is not combined with a high voltage power supply. The nozzle 24 functions as a fluid atomizing nozzle so as to generate a pressurized spray.

Figure 10:
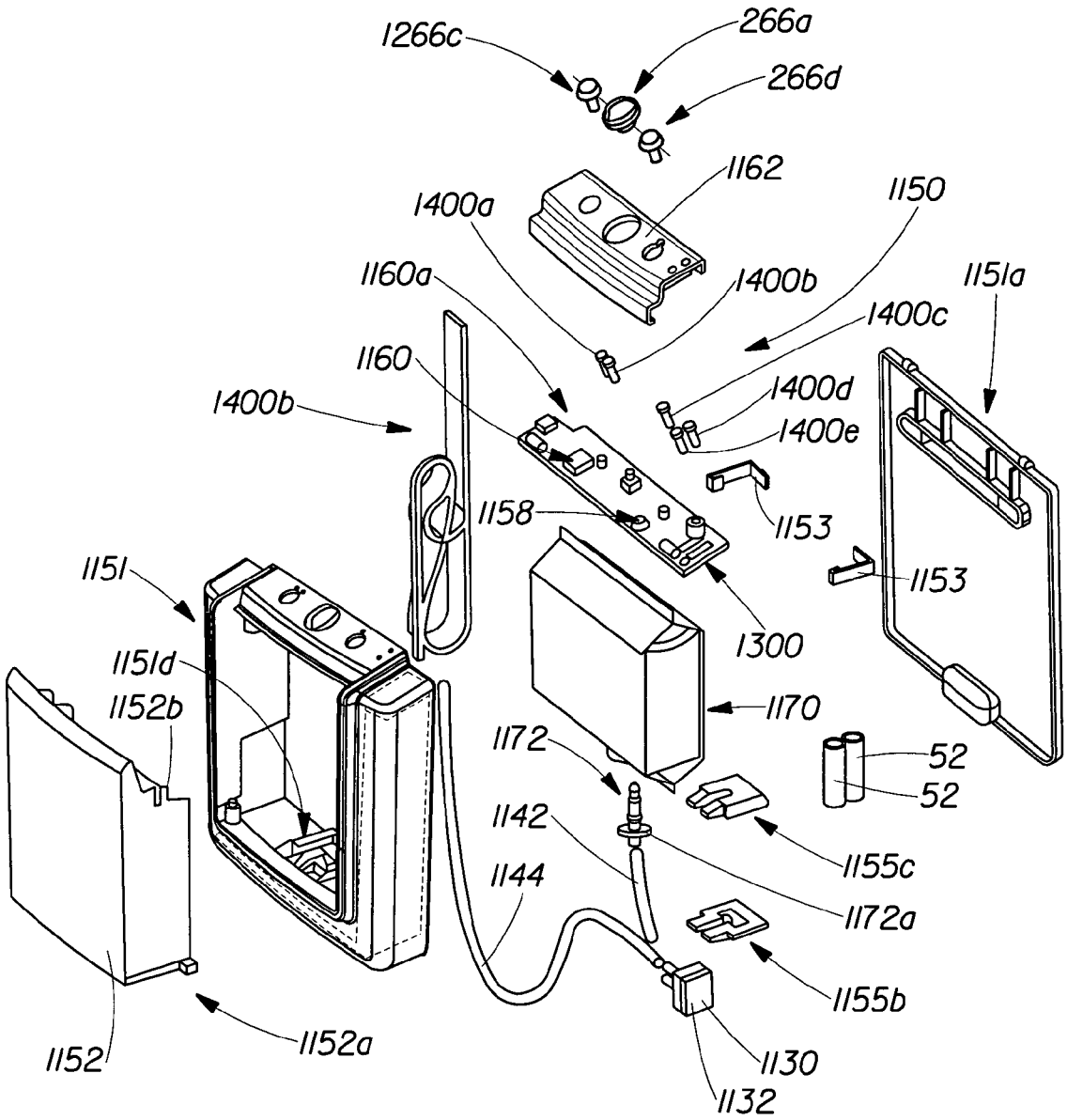
FIG. 10 is an exploded view of the unit illustrated in FIGS. 8 and 9.

The enclosure 1150 comprises a main body 1151 having a back wall 1151*a*, a first inner compartment 1151*b*, see FIG. 8, for storing varying lengths of unused cable 1140, to be described below, and a second compartment 1151*c*, see FIG. 9, for storing a fluid pump 1130, a motor 1132 for driving the pump 1130, batteries 52, a tube 1142 (to be discussed below) and a portion of a tube 1144 (to be discussed below). The enclosure 1150 further comprises a cassette door 1152 pivotably coupled to the main body 1151 such as by pins 1152*a* (only one of which is illustrated in FIG. 10), a printed circuit board 1160*a* and a face plate 1162. The printed circuit board 1160*a* is housed between the main body 1151 and the face plate 1162. The face plate 1162 is coupled to the main body 1151 via screws, adhesive, snap-fit elements, or like coupling elements. The pivotable door 1152 comprises a pocket 1152*b* for receiving a fluid reservoir defined by a removable container 1170 filled with a benefit composition, which composition may comprise any one of the benefit compositions discussed in this document or the documents noted herein. The container 1170 may be formed from a polymeric material, paper, foil, a combination of these materials or a like material. The door 1152 is releasably held in a closed position within the main body 1151 via first and second flex arms 1153, which are coupled to the main body 1151.

Extending through corresponding openings in the face plate 1162 are an ON-OFF switch 1266*c*, a "refluff" key or switch 266*d*, and a dial 266*a*, which may comprise a potentiometer, which a user rotates to dial in a desired one of a strong, regular or light setting corresponding to a strong, regular or light benefit level to be provided by a benefit composition during the drying process.

The cable 1140 is coupled to and extends between the enclosures 1120 and 1150. The cable 1140 may run along the inner surface of the fabric enhancement apparatus door, over the top of the door, and down the exterior surface of the door. Any unused length of the cable 1140 can be manually inserted into the first compartment 1151*b* for storage.

The cable 1140 carries benefit composition from the fluid pump 1130 in the outer enclosure 1150 to the nozzle 24 in the inner enclosure 1120, see FIG. 14, and electrical signals from the sensors 36, 22, 46 and 48 mounted in the inner enclosure 1120 to a microcontroller 1160 mounted to the printed circuit board 1160*a* in the outer enclosure 1150.

Figure 11:
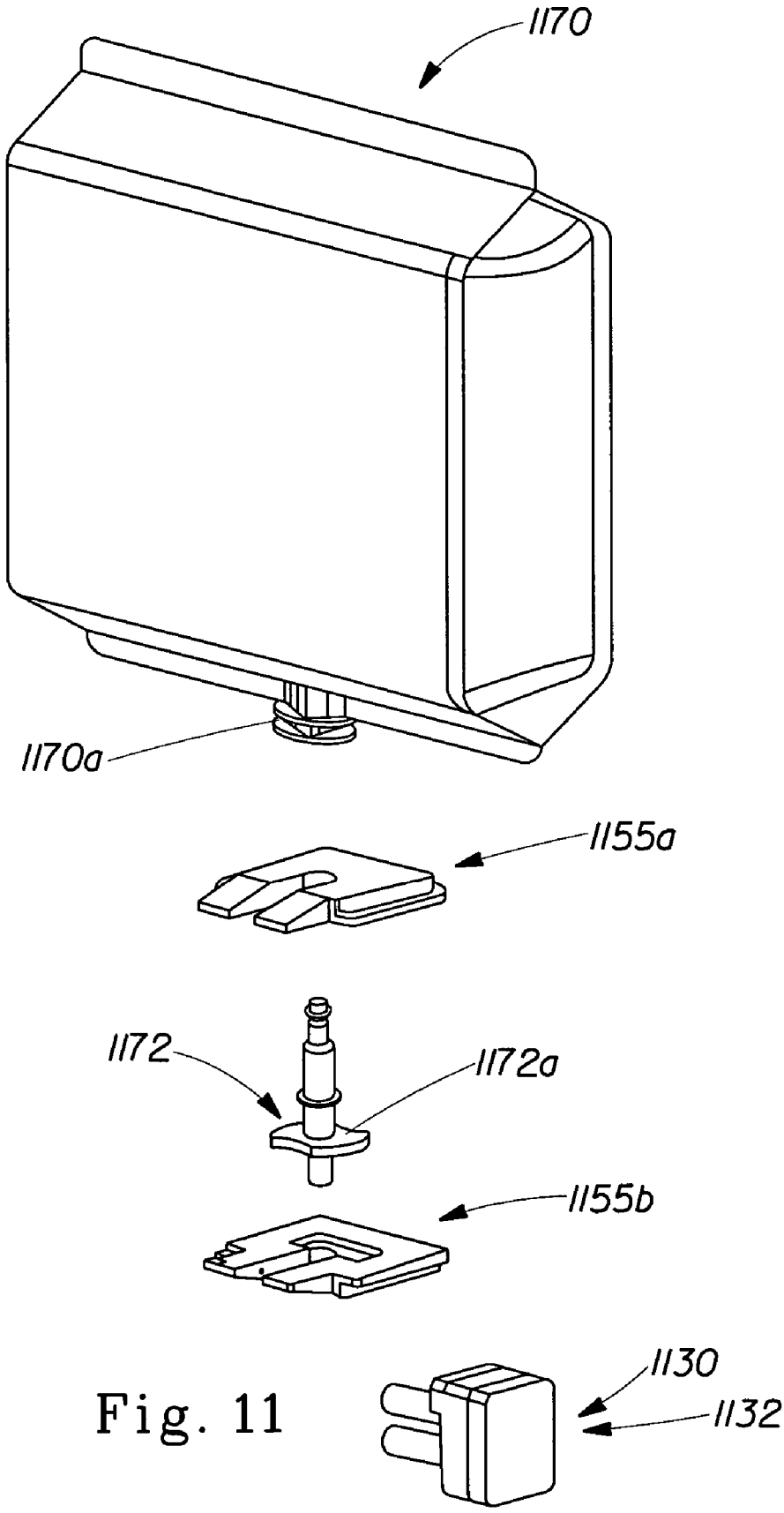
FIG. 11 is an exploded view of the fluid container, the first and second fitments and the first and second mounting shelves.
Figure 12:
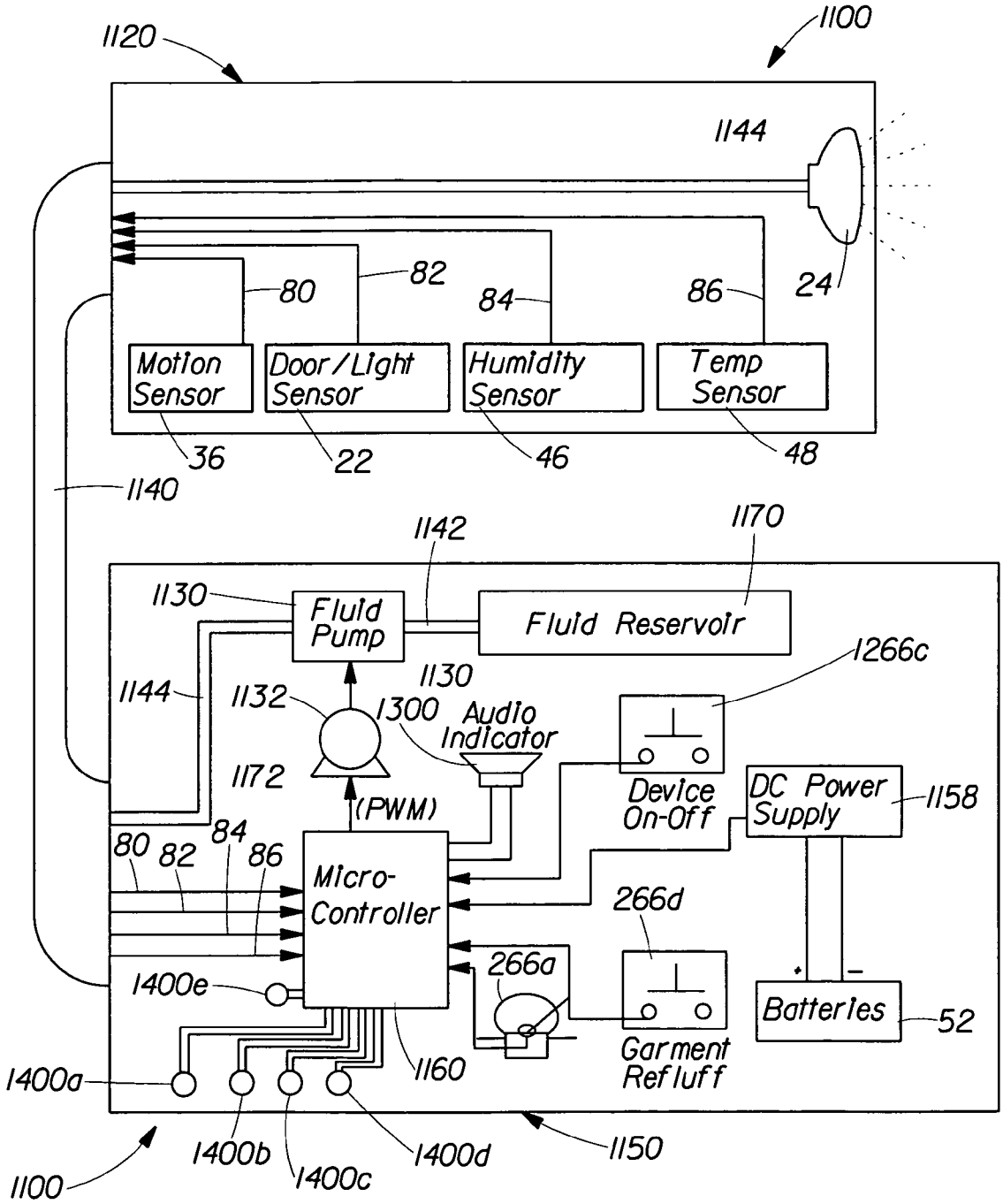
FIG. 12 is a block diagram of at least a portion of the electrical and mechanical components utilized in the unit of FIGS. 8-10.

A first fitment 1172 is mounted to the main body 1151 via first and second mounting shelves 1155*a* and 1155*b*, see FIGS. 10 and 11, and is coupled to the tube or channel 1142 (not shown in FIG. 11), which, in turn, is coupled to the pump 1130. The first and second shelves 1155*a* and 1155*b* are positioned on opposing sides of a flange 1172*a* of the first fitment 1172 and are snap fit, adhesively secured or bolted together so as to encompass the flange 1172*a*. The assembly comprising the shelves 1155*a* and 1155*b* and fitment 1172 is mounted to the main body 1151 such that the shelves 1155*a* and 1155*b* are received within a slot 1151*d* defined in the main body 1151. The fitment 1172 is inserted into a second fitment 1170*a* forming part of the fluid container 1170 when the door 1152 is pivoted to its closed position and functions to pierce or otherwise penetrate the container 1170 so as to provide a pathway for the benefit composition to travel from the container 1170 to the tube 1142. From the tube 1142, the benefit composition travels to the inlet of the pump 1130, after which the composition is pressurized and carried via the tube or channel 1144, which extends through the cable 1140, to the discharge nozzle 24, where the benefit composition is discharged. In the illustrated embodiment, the pump 1130 and the motor 1132 comprises a single assembly, namely, a piezoelectric pump, one of which is commercially available from Par Technologies, LLC, under the product designation LPD-30S.

The types of control signals used to control the electric motor 1132 can vary according to the design requirements of the apparatus 1100, and such signals will travel to the motor 1132 via an electrical conductor 1172. In the illustrated embodiment, the electrical signal traveling along conductor 1172 comprises a pulse-width modulated (PWM) signal controlled by the microcontroller 1160. Of course, such a pulse-width modulated signal can also be generated by any appropriate controller or processor, or appropriate discrete logic.

As noted above, the enclosure 1150 comprises a second compartment 1151*c* for storing batteries 52, which may comprise two AA batteries.

A suitable microcontroller 1160 is a microprocessor manufactured by Atmel Corporation and sold under the product designation Atmega48-16AI. Alternatively, the microcontroller 1160 may comprise a microprocessor manufactured by Atmel Corporation and sold under the product designation Atmega48-16AJ. Of course, other microcontrollers, microprocessors, controllers, or processors made by different manufacturers, or discrete digital logic could alternatively be used.

The microcontroller 1160 includes on-board memory and input and output lines for analog and digital signals. The microcontroller 1160 also has a serial port that can be interfaced to an optional programmer interface using an RS-232 communications link. As noted above, the ON-OFF switch 1266*c*, and the refluff key 266*d* are coupled to the microcontroller 1160, see FIG. 12. As also noted above, the motion sensor 36, door sensor 22, humidity sensor 46 and temperature sensor 48 generate signals to the microcontroller 1160. As further noted above, the microcontroller 60 generates a pulse-width modulated (PWM) signal to the pump motor 1132 via the conductor 1172. An audio indicator 1300 is further coupled to the microcontroller 1160 and functions to indicate that a drying cycle has been completed, clothes have been treated with the benefit composition, an error occurred during the benefit composition dosing cycle or the benefit composition dispensing apparatus is out of fluid. The audio indicator 1300 is mounted to the printed circuit board 1160, see FIG. 10.

Further coupled to the microcontroller 1160 are first, second, third, fourth and fifth light emitting diodes 1400*a*-1400*e*, see FIGS. 9-11. The diodes are coupled to the face plate 1162 so as to be visible to an operator when actuated, see FIG. 9. The first diode 1400*a* is actuated by the microcontroller 1160 when the apparatus 1100 is activated via the ON-OFF switch 1266*c*. The second diode 1400*b* is actuated by the microcontroller 1160 when the pump 1130 is pumping benefit composition to the nozzle 24. The third diode 1400*c* is actuated by the microcontroller 1160 when the refluff key 266*d* has been activated. The fourth diode 1400*d* is actuated by the microcontroller 1160 when the spraying operation has been completed for the corresponding fabric enhancement operation cycle. The fifth diode 1400*e* is actuated by the microcontroller 1160 to generate a warning signal when the container is out of fluid, or the fabric enhancement cycle has been interrupted, which latter event may be detected via the door sensor 22 sensing light or the motion sensor 36 sensing no motion. The microcontroller 1160 may sense that the container 1170 is out of fluid by sensing a change in the current drawn by the pump motor 1132.

It is further contemplated that a benefit composition dispensing apparatus constructed in accordance with the present invention may comprise a "single-housing" stand-alone unit similar to the one disclosed in U.S. patent application Ser. No. 10/762,152, entitled "Volatile Material Delivery Method." In such an embodiment, the apparatus comprises a single housing in which all electrical, electronic and mechanical components are housed. For example, such a single-housing stand-alone unit may comprise the components illustrated in FIG. 5 or the components illustrated in FIG. 12 of this application, which components are all housed within a single housing. The single housing is adapted to be positioned within an apparatus for effecting a fabric enhancement operation.

In most conventional dryers, whether for home use or commercial use, the heating element will be a binary device, such that it is always ON at full power or is completely OFF at zero power. A more expensive dryer apparatus could use a proportional controller to control an electrical heating element, for example, although the typical result of proportional control would nevertheless exhibit undershoots and overshoots about the setpoint temperature. The principles of the present invention could be used in such a proportional controller.

Assuming for this example that the heating element is a binary device, then while it is energized, the temperature will tend to continually increase within the drying chamber. Once the heating element is turned off, then the temperature will begin to decrease (although there could be some overshoot). During a single drying cycle, the heating element may be turned on and off several times, in which case a temperature versus time graph would have the appearance of a sawtooth waveform, in which an increasing slope (assuming temperature is the Y-axis and time is the X-axis) would occur when the heating element is turned on, and a decreasing slope when the heating element is turned off. During this sawtooth waveform interval, the overall temperature versus time chart will have the appearance of a plateau, in which the chart exhibits a relatively long increasing slope during the beginning of the drying cycle, then it reaches the plateau region (exhibiting the sawtooth waveform), and at the end of the drying cycle the slope will continually decrease on the "far" side of the plateau.

If the fabric treatment composition contains a volatile material (such as certain perfumes), then it normally would be better to not release such volatile materials into the drying chamber until the temperature of that drying chamber is below a certain level, which might not occur until after the heating cycle has been completed. One way to detect this is to know when the heating element is actually energized or not, and an integral control device that is mated into the dryer's heating element controller would have knowledge of that status for the heating element, and thus could easily prevent any dispensing or application of the fabric treatment composition until after the heating element had been de-energized at the end of a heating cycle (as opposed to during the plateau region of the heating cycle, when the heating element could turn off, but also could later turn back on).

Assuming, however, that the heating element control status is not known to the fabric treatment composition dispensing controller, which would be the case if the dispensing apparatus was a self-contained unit that is not in communication with the dryer's controller, then another means of determining the end of the heating cycle would be required. One way of determining the end of a heating cycle (or "heating event") would be to determine the maximum and minimum temperatures that occur during the sawtooth waveform portion of the heating cycle, also referred to above as the "plateau region." If, for example, the internal temperature of the dryer's chamber will rise to a maximum temperature $T_{MAX}$, and then fall to a momentary "minimum" temperature that is about 10-15° C. lower than $T_{MAX}$, then the controller for the dispensing apparatus could determine when to begin applying the fabric treatment composition, which is after the dryer's internal temperature falls below maximum temperature $T_{MAX}$, less the 10-15° C. "minimum" temperature. These sawtooth minimum and maximum temperature values can be considered a single differential temperature value, and that type of differential temperature will be referred to herein by a variable "$T_{DIFF}$". Some extra tolerance could be built in to the $T_{DIFF}$ value, so that, for example, if most home dryers rise and fall by approximately 15° C. during the plateau region of the drying cycle, then the value for $T_{DIFF}$ could be set to 20° C.

One optional aspect of the present invention is to provide the fabric treatment composition at two different time intervals during the drying cycle such as described in commonly assigned co-pending U.S. application Ser. No. 10/762,152, filed Jan. 21, 2004.

Fabric Treatment Composition

One aspect of Applicants' invention is a fabric treatment composition that can comprise a polyol-based fabric care material, a dispersing medium, and optionally, one or more adjunct materials.

In one embodiment, the fabric treatment composition comprises a polyol-based fabric care material, such as sucrose esters; a dispersing medium, such as water, alcohols, diols; and optionally, one or more adjunct materials (such as fabric care agents and adjunct materials) selected from the group consisting of softening agents, perfumes, wetting agents, emulsifiers, emulsion stabilizing agents, viscosity modifiers, pH buffers, antibacterial agents, antioxidants, radical scavengers, chelants, antifoaming agents, and mixtures thereof.

In another embodiment, the fabric treatment composition comprises from about 0.1% to about 95% by weight of the treatment composition of a polyol-based fabric care material and from about 1% to about 99% by weight of the treatment composition of a dispersing medium.

In another embodiment, the fabric treatment composition comprises a polyol-based fabric care material and a dispersing medium having the weight ratio ranging from about 1:1000 to about 90:1, or from about 1:40 to about 1:4.

In another embodiment, the fabric treatment composition comprises from about 0.1% to about 95% by weight of the treatment composition of a polyol-based fabric care material, from about 1% to about 99% by weight of the treatment composition of a dispersing medium, and the balance of one or more adjunct materials.

In another aspect of the invention, the treatment composition that is applied to the fabric article comprises a polyol-based fabric care material that has a boiling point of less than or equal to 250° C. at 1 atmosphere. Suitable polyol-based fabric care materials and sources for obtaining such materials are described herein below.

In another aspect of the invention, the treatment composition that is applied to the fabric article comprises a dispersing medium that has a flash point, as measured according to American Society for Testing and Materials (ASTM) method D93-02a, of at least about 65° C., or at least about 75° C., or at least about 95° C., or from about 65° C. to about 400° C., or from about 80° C. to about 300° C., or from about 90° C. to about 232° C.

In another aspect of the invention, the treatment composition suitable for use in the treatment system of the present invention has a viscosity of from about 1 to about 200 cps (0.001 to 0.20 Pa·s), or from about 5 to about 150 cps (0.002 to 0.15 Pa·s), or from about 10 to about 100 cps (0.01 to 0.1 Pa·s), as measured by a Brookfield viscometer model # LVDVII+ at 20° C. The spindle used for these measurements is LV1 with the appropriate rotational speed to measure compositions of different viscosities, e.g., 30 rpm to measure compositions with viscosities between about 500 cps (0.5 Pa·s) and about 1000 cps (1 Pa·s); 60 rpm to measure compositions with viscosities less than about 500 cps (0.5 Pa·s).

In another aspect of the invention, the treatment composition suitable for use in the treatment system of the present invention has a static surface tension of from about 3 to about 70 dynes/cm, or from about 5 to about 50 dynes/cm, or from about 10 to about 40 dynes/cm, at room temperature, as measured by a Kruss K12 Processor Tensiometer using the Wilhemy test method at room temperature.

Polyol-Based Fabric Care Materials

"Polyol", as used herein, means any aliphatic or aromatic compound containing at least two free hydroxyl groups. In practicing the processes disclosed herein, the selection of a suitable polyol is simply a matter of choice. For example, suitable polyols may have a backbone chain selected from the following classes: saturated or unsaturated, linear or branched or cyclic (including heterocyclic), aliphatic or aromatic (including mononuclear or polynuclear aromatics). Exemplary polyols include carbohydrates (such as saccharides), glycols (such as glycerin), and derivatives thereof (such as sugar alcohols). Monosaccharides suitable for use herein include, but are not limited to, mannose, galactose, arabinose, xylose, ribose, apiose, rhamnose, psicose, fructose, sorbose, tagitose, ribulose, xylulose, glucose, and erythrulose. Oligosaccharides suitable for use herein include, but are not limited to, maltose, kojibiose, nigerose, cellobiose, lactose, melibiose, gentiobiose, turanose, rutinose, trehalose, sucrose and raffinose. Polysaccharides suitable for use herein include, but are not limited to, amylose, glycogen, cellulose, chitin, inulin, agarose, xylans, mannan and galactans. The sugar alcohols suitable for use herein include, but are not limited to, sorbitol, erythritol, arabitol, xylitol, threitol, pentaerythritol, mannitol and galactitol.

Also suitable for use herein are other classes of polyol-based materials include sugar ethers, alkoxylated polyols, such as polyethoxy glycerol, pentaerythritol and other polyols containing amines such as glucosamine.

These polyol-based materials have the ability to modify a fabric surface to provide fabric care benefits. The derivatization or functionalization of the polyol is designed to be effective for different fabric care applications. Examples of functionalization approaches may include, but not limited to, esterification, etherification, alkylation, amidation, amination and other linking chemistries.

Typical fabric care benefits may include, but are not limited to: enhancement of fabric feel such as softness, hand and comfort; reduce or resist wrinkling; ease of ironing; enhancement of fabric color; abrasion resistance; fabric shape retention (elasticity, non-shrinkage, non-elongation); static reduction; lint reduction; faster drying; whitening; stain repellency.

Polyol-based materials suitable for use herein may have the following general formula:

$$P(OH)_{w-s}(OC(O)R^1)_x(OR^2)_yR^3_z(LR^4)_uX_v$$

wherein $P(OH)_w$ is a polyol as defined above;

$R^1$, $R^2$, $R^3$ and $R^4$ are moieties independently selected from C1-C22 alkyl or C1-C30 alkoxy, linear or branched, cyclic or acyclic, saturated or unsaturated, substituted or unsubstituted;

L is a linkage which is an atom selected from O; S; N; P;

X is a heteroatom-containing functional group, wherein the heteroatom is independently selected from O, N, S, P, Si and F;

w is an integer selected from 2 to 20;

x, y, z, u and v are integers independently selected from 0 to w;

s is the sum of x, y, z, u and v, and should be equal to or smaller than w; or $s=x+y+z+u+v \leqq w$.

In one embodiment, the polyol-based fabric care material is a sucrose derivatized by esterification and has the following formula $$P(OH)_{8-x}(OC(O)R^1)_x$$

wherein $P(OH)_8$ is sucrose;

x is an integer selected from 1 to 8, or from 2 to 8, or from 3 to 8, or from 4 to 8; and $R^1$ are independently selected from C1-C22 alkyl or C1-C30 alkoxy, linear or branched, cyclic or acyclic, saturated or unsaturated, substituted or unsubstituted.

In one embodiment, some of the $R^1$ moieties may comprise linear alkyl or alkoxy moieties comprising varying chain length. For example, $R^1$ may comprise a mixture of linear alkyl or alkoxy moieties wherein greater than about 20% of the linear chains are C18, or greater than about 50% of the linear chains are C18, or greater than about 80% of the linear chains are C18.

In another embodiment, some of the $R^1$ moieties may comprise a mixture of saturate and unsaturated alkyl or alkoxy moieties; the degree of unsaturation can be measured by "Iodine Value" (hereinafter referred as "IV", as measured by the standard AOCS method). The IV of the polyol-based fabric care material suitable for use herein ranges from about 1 to about 150, or from about 2 to about 100, or from about 5 to about 85. The $R^1$ moieties may be hydrogenated to reduce the degree of unsaturation.

In a further embodiment, some of the $R^1$ moieties may comprise unsaturated alkyl or alkoxy moieties, wherein the unsaturated moieties may comprise a mixture of "cis" and "trans" forms about the unsaturated sites. The "cis"/"trans" ratios may range from about 1:1 to about 50:1, or from about 2:1 to about 40:1, or from about 3:1 to about 30:1, or from about 4:1 to about 20:1.

The polyol-based fabric care materials are present in the treatment composition of the present invention at levels from about 0.1% to about 95%, or from about 1% to about 50%, or from about 2% to about 30%, by weight of the composition.

Dispersing Medium

The fabric treatment composition of the present invention also comprises a dispersing medium. Suitable dispersing medium include, but are not limited to, water, water soluble solvents selected from the group consisting of C4 to C10 glycol ethers, C2 to C7 glycols, polyethers, such as glycerin, and mixtures thereof.

The treatment composition may comprise, based on weight percent of the treatment composition, from about 1 wt % to about 99 wt %, from about 10 wt % to about 95 wt %, or from about 30 wt % to about 90 wt % of the dispersing medium. Typically, water comprises greater than about 40 wt %, or greater than about 60 wt %, or greater than about 80%, or greater than about 90 wt % of the treatment composition; the balance of the dispersing medium comprises water soluble solvents.

When fabric treatment composition comprises water, the pH of said composition may be in the range of from about 2 to about 10, from about 3 to about 9, from about 4 to about 8, or from about 5.5 to about 7.5. Commonly known pH buffers, such as those disclosed below in the "Adjunct materials", can be used to adjust and/or control the pH of the composition.

Adjunct Materials

The treatment composition may also comprise optional adjunct materials. Adjunct materials include, but are not limited to, wetting agents, emulsifiers, emulsion stabilizing agents, viscosity modifiers, pH buffers, antibacterial agents, antioxidants, radical scavengers, chelants, antifoaming agents, fabric care agents such as softening agents, perfumes, and mixtures thereof.

When present, each adjunct material is present, based on total composition weight, at one of the following levels, at least about 0.5 wt %, at least about 2 wt %, from about 4 wt % to about 90 wt %, from about 4 wt % to about 50 wt %, or from about 4 wt % to about 10 wt %.

The composition of the present invention may optionally comprise one or more fabric care materials. These fabric care material provides one or more fabric benefits including, but not limited to, softness, odor, anti-soil re-deposition, stain or water repellency, color or whiteness enhancement, enhanced absorbency, anti-static, anti-bacterial, or fabric abrasion resistance. Some representative, but nonlimiting examples of fabric care materials, such as softening agnets, are described below.

Exemplary softening agents include, but are not limited to, diester quaternary ammonium compounds (DEQA); polyquaternary ammonium compounds; triethanolamine esterified with carboxylic acid and quaternized (so called "esterquat"); amino esterquats; cationic diesters; betaine esters; betaines; silicone or silicone emulsions comprising aminosilicones, cationic silicones, quat/silicone mixtures; functionalized PDMS; amine oxides; and mixtures thereof.

Nonlimiting examples of quaternaty ammonium type softeners may be selected from the group consisting of: N,N-dimethyl-N,N-di(tallowyloxyethyl) ammonium methylsulfate, N-methyl-N-hydroxyethyl-N,N-di(canoyloxyethyl) ammonium methylsulfate, N,N-ditallow N,N-dimethyl ammonium chloride, N,N-ditallowylethanol N,N-dimethyl ammonium chloride, and mixtures thereof.

Additional examples of non-silicone fabric softening agents and deposition aids are described in EP 902 009; WO 99/58492; U.S. Pat. No. 4,137,180; WO 97/08284; WO 00/70004; WO 00/70005; WO 01/46361; WO 01/46363; WO 99/64661; WO 99/64660; JP 11-350349; JP11-081134; and JP 11-043863. Additional examples of silicone fabric softening agents and deposition aids are described in U.S. Pat. Nos. 4,448,810; 4,800,026; 4,891,166; 5,593,611; EP 459 821; EP 530 974; WO 92/01773; WO 97/32917; WO 00/71806; WO 00/71807; WO 01/07546; WO 01/23394; JP 2000-64180; JP 2000-144199; JP 2000-178583; and JP 2000-192075.

Some of the softening agents are described in details below. Suitable protonatable amines include, protonatable amines having Formula I below:

Formula I

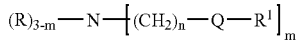

wherein the index m=0, 1, 2 or 3; the index n=1, 2, 3 or 4, preferably n is 2 or 3, more preferably n is 2, each R is independently selected from $C_1$-$C_{22}$ alkyl, $C_1$-$C_{22}$ hydroxyalkyl or a benzyl group; each $R^1$ is independently selected from $C_{11}$-$C_{22}$ linear alkyl, $C_{11}$-$C_{22}$ branched alkyl, $C_{11}$-$C_{22}$ linear alkenyl, or $C_{11}$-$C_{22}$ branched alkenyl; and each Q may comprise a carbonyl, carboxyl, or amide moiety.

Suitable alkylated quaternary ammonium compounds (quats), include mono-alkyl quats, di-alkyl, tri-alkyl quats and tetra-alkyl quats and certain cationic surfactants. Suitable mono-alkyl quats, di-alkyl, tri-alkyl quats and tetra-alkyl quats typically have Formula II below:

Formula II

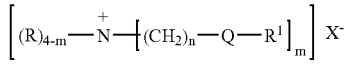

wherein the index m=0, 1, 2, 3 or 4; the index n=1, 2, 3 or 4, preferably n is 2 or 3, more preferably n is 2, each R is independently selected from $C_1$-$C_{22}$ alkyl, $C_1$-$C_{22}$ hydroxyalkyl, or a benzyl group; each $R^1$ is independently selected from $C_{11}$-$C_{22}$ linear alkyl, $C_{11}$-$C_{22}$ branched alkyl, $C_{11}$-$C_{22}$ linear alkenyl, or $C_{11}$-$C_{22}$ branched alkenyl; $X^-$ is a water soluble anionic species such as chloride, bromide or methyl sulfate, and Q may comprise a carbonyl, carboxyl, or amide moiety.

Suitable cationic surfactants include quaternary ammonium surfactants selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Another preferred cationic surfactant is $C_6$-$C_{18}$ alkyl or alkenyl ester of an quaternary ammonium alcohol, such as quaternary choline esters. More preferably, the cationic surfactants have Formula III below:

Formula III

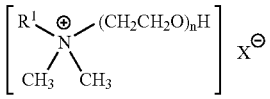

wherein $R^1$ is a $C_8$-$C_{18}$ hydrocarbyl, preferably $C_{8-14}$ alkyl, more preferably $C_8$, $C_{10}$ or $C_{12}$ alkyl, and $X^-$ is a water soluble anionic species such as chloride, bromide or methyl sulfate.

Suitable cationic silicones include silicones functionalized by amine derived compounds and cationic silicone polymers. Suitable silicones functionalized by amine derived compounds include amino silicones having Formula IV below:

$$(R^1R^2R^3SiO_{1/2})_p(R^4R^4SiO_{2/2})_m[R^4Si(L\text{-}NR^5R^6)O_{2/2}]_a[Si(K\text{-}NR^7R^8)O_{3/2}]_b[R^4SiO_{3/2}]_c \quad \text{Formula IV}$$

wherein m, a, b, and c are independently selected from integers between 0 and 6000; p=2+b+c; $R^1$, $R^2$, $R^3$, $R^4$, $R^5$, $R^6$, $R^7$ $R^8$, L, K are various side chains attached to the silicone or nitrogen atoms within the molecule. In Formula IV above, $R^1$, $R^2$, $R^3$, $R^4$ are independently selected from:

1.) $C_1$-$C_{22}$ linear or branched, substituted or unsubstituted hydrocarbyl moiety; or 2.) —O—$R^{11}$, —O—$R^{12}$, —O—$R^{13}$, and —O—$R^{14}$, wherein $R^{11}$, $R^{12}$, $R^{13}$, and $R^{14}$ are independently selected from H, or $C_1$-$C_{22}$ linear or branched, substituted or unsubstituted hydrocarbyl moiety.

In Formula IV above, L and K are independently selected from $C_1$-$C_{22}$ linear or branched, substituted or unsubstituted hydrocarbyl moieties. Preferably L and K are independently selected from $C_1$-$C_{12}$ linear or branched, substituted or unsubstituted hydrocarbyl moieties. More preferably L and K are independently selected from $C_1$-$C_4$ linear or branched, substituted or unsubstituted hydrocarbyl moieties. Most preferably L and K are independently selected from methylene, ethylene, propylene, 2-methylpropylene, butylene, octadecylene or 3-(2,2',6,6'-tetramethyl-4-oxy-piperidyl) propyl. In Formula IV above, $R^5$, $R^6$, $R^7$ and $R^8$ are independently selected from H, or $C_1$-$C_{22}$ linear or branched, substituted or unsubstituted hydrocarbyl moieties. As used in Formula IV above, "$SiO_{n/2}$" means the ratio of oxygen atoms to silicon atoms, i.e., $SiO_{1/2}$ means one oxygen atom is shared between two silicon atoms.

Suitable cationic silicone polymers include cationic silicone polymers having Formula V below:

$$[CAP]\text{-}Z_m\text{-}[CAP] \quad \text{Formula V}$$

wherein [CAP] is a backbone termination or truncation unit; m is an integer from 1 to 50 and each Z unit has Formula VI below:

$$—(R)_x—W—(R)_x— \quad \text{Formula VI}$$

wherein for Formula VI:

x is 0 or 1;

W is a siloxane unit having Formula VII below:

Formula VII

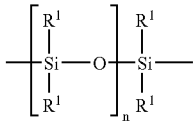

wherein for Formula VII each $R^1$ unit is a $C_1$-$C_{22}$ linear or branched, substituted or unsubstituted hydrocarbyl moiety;

wherein for Formula VI above R has Formula VIII below:

$$\text{-}[(L)_y\text{-}(R^2)_y\text{-}(L)_y]\text{-}B\text{-}[(L)_y\text{-}(R^2)_y\text{-}(L)_y]\text{-} \quad \text{Formula VIII}$$

wherein for Formula VIII above:

y is 0 or 1;

L is a suitable carbon containing linking unit, suitable linking units include, but are not limited to, alkylene moieties, acrylate moieties, and amide containing moieties;

each B is a unit comprising at least one secondary, tertiary, or quaternary amino moiety;

$R^2$ is a coupling unit having the Formula IX below:

Formula IX

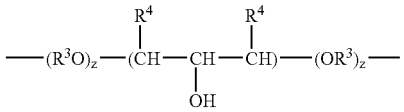

wherein for Formula IX above:

each $R^3$ is independently selected from a $C_2$-$C_{12}$ linear or branched alkylene moiety, preferably each $R^3$ is independently ethylene, 1,3-propylene, or 1,2-propylene;

each $R^4$ is independently selected from hydrogen, or a $C_1$-$C_{22}$ linear or branched, substituted or unsubstituted hydrocarbyl moiety, preferably each $R^4$ is independently selected from hydrogen, a $C_1$-$C_{22}$ linear or branched alkyl moiety; a $C_1$-$C_{22}$ cycloalkyl moiety; a $C_1$-$C_{22}$ linear or branched fluoroalkyl moiety; a $C_2$-$C_{22}$ linear or branched alkenyl moiety; a $C_6$-$C_{22}$ aryl moiety; or a $C_7$-$C_{22}$ alkylenearyl moiety; most preferably each $R^4$ is hydrogen, or a $C_1$-$C_{10}$ linear or branched alkyl moiety; and z is an integer from 0 to 50;

Other suitable fabric materials may be polymeric materials such as polyacrylates, polyvinylalcohols, polyethyleneglycols, and derivatives or copolymers of the aforementioned materials.

Non-limiting examples of suitable silicone copolyols are silicone copolyols having Formula X below:

$$R^1—(CH_3)_2SiO—[(CH_3)_2SiO]_a—[(CH_3)(R^1)SiO]_b—Si(CH_3)_2—R^1 \quad \text{Formula X}$$

wherein for Formula X above, a+b is an integer from 1 to about 50, preferably a+b is an integer from about 3 to about 30, more preferably a+b is an integer from about 10 to about 25; and at least one $R^1$ is a poly(ethyleneoxy/propyleneoxy) copolymer group having Formula XI below and the remaining $R^1$ moieties are independently selected from the group consisting of methyl and the poly(ethyleneoxide/propyleneoxide) copolymer group having Formula XI below:

$$—(CH_2)_nO(C_2H_4O)_c(C_3H_6O)_dR^2 \quad \text{Formula XI}$$

wherein for Formula XI above, n is 3 or 4, preferably n is 3; c is an integer from 1 to about 100, preferably c is an integer from about 6 to about 100; d is an integer from 1 to about 14, and preferably d is an integer from 1 to about 3; the total of c+d is an integer of from about 5 to about 150, preferably the total of c+d is an integer from about 9 to about 100; and each $R^2$ is independently selected from the group consisting of hydrogen, an alkyl moiety comprising up to 4 carbon atoms, or an acetyl group.

Nonlimiting examples of emulsifiers include amine oxides, alkyl polyglucosides, cetyltrimethyl ammonium chloride, alkyl sulfates, alkyl sulfonates, alkyl ethoxylates, alkyl ethoxy sulfates, and mixtures thereof.

Nonlimiting examples of emulsion stabilizing agent is selected from the group consisting of ethoxylated terepthalate, arabinogalactan, ethoxylated polyethylene imines, and mixtures thereof.

Nonlimiting examples of viscosity modifiers include salts, such as $CaCl_2$, $MgCl_2$, NaCl, guar gum, polysaccharides, and mixtures thereof. Other salts containing and other alkali or alkaline earth metal cations and halide anions, and the like, are also suitable.

Nonlimiting examples of pH buffers include citric acid, lactic acid, succinic acid, phosphoric acid, sodium bicarbonate, and mixtures thereof.

The antibacterial agents include didecyl dimethyl ammonium chloride, which is available under the tradename Uniquat® (from Lonza), 1,2-benzisothiozolin-3-one, which is available under the tradename Proxel® (from Zeneca Inc.), dimethylol-5,5-dimethylhydantoin, which is available under the tradename Dantoguard® (from Lonza) and 5-Chloro-2-methyl-4-isothiazolin-3-one/2-methyl-4-isothiazolin-3-one, which is available under the tradename Kathon® (from Rohm and Haas).

The antioxidants include, but are not limited to tocopherol acetates, quinines, polyphenols, and mixtures thereof.

The radical scavengers include, but are not limited to propyl gallate, polyimines, trimethoxy benzoic acid and mixtures thereof.

The chelants include, but are not limited to diethylene triamine pentaacetic acid, ethylene diamine teraacetic acid, diethylene triamine pentamethylethylene phosphomic acid, citric acid and mixtures thereof.

The antifoaming agent include, but are not limited to silicone oils, ethoxylated surfactants, Tetronics® (available from BASF), and mixtures thereof.

Other examples of ethoxylated surfactant include, but are not limited to, carboxylated alcohol ethoxylates; ethoxylated quaternary ammonium surfactants; and ethoxylated alkyl amines. Nonlimiting examples of ethoxylated surfactants are provided:

a) $C_9$-$C_{18}$ alkyl ethoxylates, such as Neodol® nonionic surfactants from Shell;

b) $C_6$-$C_{12}$ alkyl phenol alkoxylates wherein the alkoxylate units are a mixture of ethyleneoxy and propyleneoxy units;

c) $C_{12}$-$C_{18}$ alcohol and $C_6$-$C_{12}$ alkyl phenol condensates with ethylene oxide/propylene oxide block polymers such as Pluronic® from BASF;

d) $C_{14}$-$C_{22}$ mid-chain branched alcohols, BA, as discussed in U.S. Pat. No. 6,150,322;

e) $C_{14}$-$C_{22}$ mid-chain branched alkyl alkoxylates, $BAE_x$, wherein x 1-30, as discussed in U.S. Pat. Nos. 6,153,577, 6,020,303 and 6,093,856;

f) ether capped poly(oxyalkylated) alcohol surfactants as discussed in U.S. Pat. No. 6,482,994, WO 01/42408, and WO 01/42408; and g) fatty acid ($C_{12-18}$) sorbitan esters, Span®, and their ethoxylated ($EO_{5-100}$) derivatives, polysorbates; such as Span®20, Tween® 20, Tween® 60, Tween® 80 (commercially available from Uniqema).

Other examples of ethoxylated surfactant include carboxylated alcohol ethoxylates; ethoxylated quaternary ammonium surfactants; and ethoxylated alkyl amines.

Suitable nonionic materials include certain surfactants produced by the condensation of alkylene oxide groups with an organic hydrophobic moiety, said moiety can be aliphatic or alkyl aromatic in nature; silicone copolyols; and mixtures thereof. Examples of suitable nonionic surfactants include, but are not limited to alkyl phenol ethoxylates, polyethylene glycol/polypropylene glycol block copolymers, fatty alcohol and fatty acid ethoxylates, long chain tertiary amine oxides, alkyl polysaccharide, polyethylene glycol (PEG) glyceryl fatty esters and mixtures thereof.

The perfume materials may be obtained from one or more of the following perfume material suppliers Firmenich (Geneva, Switzerland), Givaudan (Argenteuil, France), IFF (Hazlet, N.J.), Quest (Mount Olive, N.J.), Bedoukian (Danbury, Conn.), Sigma Aldrich (St. Louis, Mo.), Millennium Specialty Chemicals (Olympia Fields, Ill.), Polarone International (Jersey City, N.J.), Fragrance Resources (Keyport, N.J.), and Aroma & Flavor Specialties (Danbury, Conn.).

Suitable particulate materials include inorganic or organic particulates such as polymeric particles, clays, talcs, zeolites and mixtures thereof. Suitable polymeric particles typically have an average particle size less than about 10 microns, preferably less than 5 microns, more preferably less than about 1 micron. Such particles may comprise polyethylene, polystyrene, polypropylene and mixtures thereof. Suitable clay materials include phyllosilicate clays with a 2:1 layer structure, such as smectite clays for example pyrophyllite, montmorillonite, hectorite, saponite and vermiculite, and micas. Particularly suitable clay materials include smectite clays described in U.S. Pat. No. 4,062,647. Other disclosures of suitable clay materials for fabric softening purposes include European patent specification EP 26528-A1, U.S. Pat. Nos. 3,959,155 and 3,936,537.

Other suitable adjunct materials include, but are note limited to, preservatives such as benzyl alcohol, methyl paraben, propyl paraben and imidazolidinyl urea; suspending agents such as magnesium/aluminum silicate; sequestering agents such as disodium ethylenediamine tetraacetate; and certain synthetic or naturally-derived oils and/or fats, such as certain triglycerides, mineral oils, and mixtures thereof. Specific examples of oils or fats suitable for use herein as adjunct materials include but are not limited to; triglycerides from beef tallow, palm oil, cottonseed oil, canola oil, and soybean oil, all with varying levels of hydrogenation; paraffin oils, and mixtures thereof.

Additional adjunct materials further include, but are not limited to, wrinkle releasing/prevention agent, anti-static agent, crystal modifier, soil release/prevention agent, colorant, brightener, odor reducer/eliminator, deodorizer/refresher agent, stain repellent, color enhancer, perfume release and/or delivery agent, shape retention agent, fiber rebuild agent, fiber repair agent, and mixtures thereof.

Additional examples of suitable adjuncts and levels of use are found in U.S. Pat. No. 6,653,275.

Suitable adjunct materials are commercially available from Mazer Chemicals (Gurnee, Ill., USA), Clariant Corporation (Glattbrugg, Switzerland), Rhodia Incorporated (Cranbury, N.J., USA), Scher Chemicals, Inc. (Clifton, N.J., USA), Dow Corning Corporation (Midland, Mich., USA) and General Electric Company (Fairfield, Conn., USA), Witco Corporation (Middlebury, Conn., USA), Degussa-Huls (Marl, Germany), BASF (Mount Olive, N.J., USA), Sigma-Aldrich (St. Louis, Mo., USA), 20 Microns Ltd. (Baroda, India), and Twin Rivers Technologies (Quincy, Mass., USA).

Processes of Making Fabric Treatment Compositions

The fabric treatment compositions of the present invention can be formulated into any suitable form and prepared by any process chosen by the formulator, non-limiting examples of which are described in U.S. Pat. No. 6,653,275.

EXAMPLES

The following compositions are examples of fabric treatment compositions useful in the present invention:

| Component | A | B | C | D | E | F |
|---|---|---|---|---|---|---|
| Sucrose fatty esters (7 ester groups) | 2 | 2 | 2 | 0 | 3 | 8 |
| Sucrose fatty esters (4 ester groups) | 0 | 0 | 0 | 2 | 3 | 0 |
| DTDMAC [a] | 6 | 0 | 0 | 6 | 1 | 0 |
| DTDMAMS [b] | 0 | 6 | 0 | 0 | 0 | 0 |
| DEEHMAMS [c] | 0 | 0 | 6 | 0 | 0 | 0 |
| CTMAC [d] | 0 | 0 | 0 | 0 | 1 | 2 |
| Lactic acid | 0.1 | 0.1 | 0.1 | 0.1 | 0.1 | 0 |
| Proxel ® [e] | 0.1 | 0.1 | 0.1 | 0.1 | 0.1 | 0.1 |
| Dantoguard ® [f] | 0.15 | 0.15 | 0.15 | 0.15 | 0.15 | 0.15 |
| Phenoxyethanol | 0.1 | 0.1 | 0.1 | 0.1 | 0.1 | 0.1 |
| Propylene glycol, n-butyl ether | 2 | 2 | 2 | 1 | 1 | 0 |
| 1,2 Propanediol | 4 | 4 | 4 | 0 | 2 | 0 |
| $CaCl_2$ | 0.1 | 0.1 | 0 | 0.05 | 0.1 | 0.05 |
| $Na_2SO_4$ | 0 | 0 | 0.1 | 0 | 0 | 0 |
| TMBA [g] | 0.05 | 0.05 | 0.05 | 0.05 | 0.05 | 0.1 |
| DTPA [h] | 0.05 | 0.05 | 0.05 | 0.05 | 0.05 | 0.1 |
| Water | Bal. | Bal. | Bal. | Bal. | Bal. | Bal. |
| TOTAL | 100 | 100 | 100 | 100 | 100 | 100 |

[a] DTDMAC = Di-Tallow Di-methyl Ammonium Chloride
[b] DTDMAMS = Di-Tallow Di-methyl Ammonium Methyl Sulfateb.
[c] DEEHMAMS = Di-(Tallow oxyethyl) Hydroxy Ethyl Methyl Ammonium Methyl Sulfate
[d] CTMAC = Cetyl Trimethyl Ammonium Chloride
[e] Proxel ® = 1,2-Benzisothiozolin-3-one
[f] Dantoguard ® = Dimethylol-5,5-Dimethylhydantoin
[g] TMBA = Trimethoxy Benzoic Acid
[h] DTPA = Sodium Diethylene Triamine Pentaacetate It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All documents cited are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric article treating system comprising:

(a) a fabric article drying appliance; and (b) a fabric article treating device removably attached to said drying appliance, said treating device comprising a source containing a fabric treatment composition and means for dispensing said composition in said drying appliance, said means is in liquid communication with said source;

wherein said composition comprises a polyol-based fabric care material and a dispersing medium wherein the polyol-based fabric care material has the following formula:

$$P(OH)_{w-5}(OC(O)R^1)_x(OR^2)_yR^3_z(LR^4)_uX_v$$

wherein $P(OH)_w$ is a polyol, $R^1$, $R^2$, $R^3$ and $R^4$ are moieties independently selected from C1-C22 alkyl or C1-C30 alkoxy, linear or branched, cyclic or acyclic, saturated or unsaturated, substituted or unsubstituted;

L is a linkage, which is an atom selected from O; S; N; P;

X is a heteroatom-containing functional group, wherein the heteroatom is independently selected from O, N, S, P, Si and F;

w is an integer selected from 2 to 20;

x, y, z, u and v are integers independently selected from 0 to w;

s is the sum of x+y+z+u+v and $s \leqq w$;

2. The system of claim 1 wherein the dispersing medium is water or a water soluble solvent selected from the group consisting of C4 to C10 glycol ethers, C2 to C7 glycols, polyethers, and mixtures thereof.

3. The system of claim 1 wherein the dispersing medium is liquid at room temperature.

4. The system of claim 1 wherein the dispersing medium has a flash point of at least about 65° C.

5. The system of claim 1 wherein the polyol-based fabric care material is a sucrose ester having the formula:

$$P(OH)_{8-x}(OC(O)R^1)_x$$

wherein $P(OH)_8$ is sucrose;

x is an integer selected from 1 to 8;

$R^1$ is independently selected from C1-C22 alkyl or C1-C30 alkoxy, linear or branched, cyclic or acyclic, saturated or unsaturated, substituted or unsubstituted.

6. The system of claim 1 wherein the composition further comprising one or more adjunct material selected from the group consisting of:

(a) a wetting agent;

(b) an emulsifier;

(c) an emulsion stabilizing agent;

(d) a viscosity modifier;

(e) a pH buffer;

(f) an antibacterial agent;

(g) an antioxidant;

(h) a radical scavenger;

(i) a chelant;

(j) an antifoaming agent;

(k) a softening agent;

(l) a perfume; and (m) mixtures thereof.

7. The system of claim 6 wherein the wetting agent is selected from the group consisting of silicone copolyols, dioctyl sulfosuccinate, acetylene surfactants and mixtures thereof;

the emulsifier is selected from the group consisting of amine oxide, alkyl polyglucoside, cetytrimethyl ammonium chloride, alkyl sulfates, alkyl sulfonates, alkyl ethoxylates, alkyl ethoxy sulfates, and mixtures thereof;

the emulsion stabilizing agent is selected from the group consisting of ethoxylated terepthalate, arabinogalactan, ethoxylated polyethylene imines, and mixtures thereof;

the viscosity modifier is selected from the group consisting of CaCl2, $MgCl_2$, NaCl, guar gum, polysaccharides, and mixtures thereof;

the pH buffer is selected from the group consisting of citric acid, lactic acid, succinic acid, phosphoric acid, sodium bicarbonate, and mixtures thereof;

the antibacterial agent is selected from the group consisting of didecyl dimethyl ammonium chloride, 1,2-benzisothiozolin-3-one, 1,3-bis (hydroxymethyl)-5,5-dimethyl hydantoin, 5-chloro-2 methyl-4 isothiazolin-3-one, and mixtures thereof;

the antioxidant is selected from the group consisting of tocopherol acetates, quinines, polyphenols, and mixtures thereof;

the radical scavenger is selected from the group consisting of propyl gallante, trimethoxybenzioc acid (TMBA), polyimines, and mixtures thereof;

the chelant is selected from the group consisting of diethylene triamine pentacetic acid, ethylene diamine tetra acetic acid, diethylene triamine pentamethylene phosphonic acid, and mixtures thereof;

the antifoaming agent is selected from the group consisting of silicone oils, ethoxylated surfactants, ethylene diamine polyglycol ether, ethylene oxide/propylene oxide block copolymer, and mixtures thereof; and the softening agent is a dialkyl quaternary ammonium compound selected from the group consisting of N,N-ditallow N,N-dimethyl ammonium chloride and N, N-di-tallowoylethanolester N,N-dimethylammonium chloride, and mixtures thereof.

8. The system of claim 6 wherein the composition further comprising an adjunct selected from the group consisting of wrinkle releasing/prevention agent, anti-static agent, crystal modifier, soil release/prevention agent, colorant, brightener, odor reducer/eliminator, deodorizer/refresher agent, stain repellent, color enhancer, perfume release and/or delivery agent, shape retention agent, fiber rebuild agent, fiber repair agent, and mixtures thereof.

9. The system of claim 1 wherein the composition comprising from about 0.1% to about 95% by weight of the composition of the polyol-based fabric care material; from about 1% to about 99% by weight of the composition of the dispersing medium; and the balance one or more adjunct materials.

10. The system of claim 1 wherein said composition has a viscosity of about 1 to about 200 cps at room temperature.

11. The system of claim 1 wherein said composition has a static surface tension of about 3 to about 70 dynes/cm at room temperature.

12. The system of claim 1 wherein the dispensing means comprises a nozzle.

13. The system of claim 1 wherein the composition is dispensed in the form of droplets.

14. The system of claim 13 wherein the droplets have an average particle size of from about 0.1 to about 1000 microns.

15. A fabric article treating system comprising:

a) a fabric article drying appliance; and b) a fabric article treating device included with said drying appliance, said treating device comprising a source containing a fabric treatment composition and means for dispensing said composition in said drying appliance, said means is in liquid communication with said source;

wherein said composition comprises a polyol-based fabric care material and a dispersing medium, wherein the polyol-based fabric care material has the following formula:

$$P(OH)_{w-s}(OC(O)R^1)_x(OR^2)_yR^3_z(LR^4)_uX_v$$

wherein $P(OH)_w$ is a polyol, $R^1$, $R^2$, $R^3$ and $R^4$ are moieties independently selected from C1-C22 alkyl or C1-C30 alkoxy, linear or branched, cyclic or acyclic, saturated or unsaturated, substituted or unsubstituted;

L is a linkage, which is an atom selected from O; S; N; P;

X is a heteroatom-containing functional group, wherein the heteroatom is independently selected from O, N, S, P, Si and F;

w is an integer selected from 2 to 20;

x, y, z, u and v are integers independently selected from 0 to w;

s is the sum of x+y+z+u+v and $s \leqq w$.

16. The fabric article treating system of claim 15 wherein said source is a reservoir.

17. The fabric article treating system of claim 16 wherein said reservoir is a pouch or a cartridge.

18. The fabric article treating system of claim 16 wherein said reservoir is connected to a source of said dispersing medium.

* * * * *